US010711380B2

(12) United States Patent
Luedecke et al.

(10) Patent No.: US 10,711,380 B2
(45) Date of Patent: Jul. 14, 2020

(54) ARTICLE WITH EMBROIDERED TAPE SEGMENTS

(71) Applicant: Under Armour, Inc., Baltimore, MD (US)

(72) Inventors: Tom Luedecke, Portland, OR (US); Carmen Zhu, Guangzhou (CN)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 15/648,638

(22) Filed: Jul. 13, 2017

(65) Prior Publication Data

US 2019/0017205 A1 Jan. 17, 2019

(51) Int. Cl.

| | |
|---|---|
| ***A43B 1/04*** | (2006.01) |
| ***D05C 7/08*** | (2006.01) |
| ***D02G 3/32*** | (2006.01) |
| ***D02G 3/44*** | (2006.01) |
| ***D05C 11/06*** | (2006.01) |
| ***A43B 23/02*** | (2006.01) |
| ***A43B 5/00*** | (2006.01) |
| ***A43B 23/04*** | (2006.01) |

(52) U.S. Cl.

CPC ..... *D05C 7/08* (2013.01); *A43B 1/04* (2013.01); *A43B 5/00* (2013.01); *A43B 23/0205* (2013.01); *A43B 23/025* (2013.01); *A43B 23/0235* (2013.01); *A43B 23/04* (2013.01); *D02G 3/32* (2013.01); *D02G 3/44* (2013.01); *D05C 11/06* (2013.01); *D05D 2305/26* (2013.01)

(58) Field of Classification Search

CPC ..... A43B 1/02; A43B 1/04; A43B 23/0205; A43B 23/0225; A43B 23/0235; A43B 23/025

USPC ..... 36/45

See application file for complete search history.

(56) References Cited

U.S. PATENT DOCUMENTS

| | | | |
|---|---|---|---|
| 313,301 | A | 3/1885 | Cross |
| 889,181 | A | 5/1908 | Davis |
| 1,124,184 | A | 1/1915 | Straub |
| 1,217,463 | A | 2/1917 | Krieger |
| 1,314,239 | A | 8/1919 | Bancroft |
| 1,469,222 | A | 10/1923 | La Chapelle |
| 2,413,824 | A | 1/1947 | Glassman |

(Continued)

FOREIGN PATENT DOCUMENTS

| | | |
|---|---|---|
| CN | 2712122 | 7/2005 |
| CN | 201431021 | 3/2010 |

(Continued)

OTHER PUBLICATIONS

International Search Report and Written Opinion dated Sep. 20, 2018 for International Application No. PCT/US2018/39904.

(Continued)

*Primary Examiner* — Marie D Bays

(74) *Attorney, Agent, or Firm* — Plumsea Law Group, LLC

(57) ABSTRACT

An article comprised of tape segments embroidered in place is disclosed. One embodiment includes tape segments embroidered to a self-supporting embroidered structure. Another embodiment includes tape segments embroidered together to form an embroidered lattice structure. In one embodiment, some of the tape segments may expand when exposed to heat and may be used to form cushioning regions for the article.

20 Claims, 15 Drawing Sheets

(56) References Cited

U.S. PATENT DOCUMENTS

| | | | | |
|---|---|---|---|---|
| 3,570,151 | A | 3/1971 | Eaton | |
| 3,704,474 | A | 12/1972 | Winkler | |
| 4,027,406 | A | 6/1977 | Salvatore | |
| 4,254,563 | A * | 3/1981 | Bruno | A43B 1/02 12/142 G |
| 4,393,605 | A * | 7/1983 | Spreng | A43B 5/06 36/102 |
| 5,673,639 | A | 10/1997 | Miyachi et al. | |
| 6,060,145 | A | 5/2000 | Smith et al. | |
| 6,267,068 | B1 | 7/2001 | Fickers et al. | |
| 7,032,328 | B2 | 4/2006 | Wilson et al. | |
| 7,089,691 | B1 | 8/2006 | Silvera | |
| 7,115,315 | B2 | 10/2006 | Fowler | |
| 7,293,371 | B2 | 11/2007 | Aveni | |
| 8,122,616 | B2 | 2/2012 | Meschter et al. | |
| 8,595,878 | B2 | 12/2013 | Huffa et al. | |
| 8,656,606 | B2 | 2/2014 | Hooper | |
| 9,179,739 | B2 | 11/2015 | Bell et al. | |
| 9,420,844 | B2 | 8/2016 | Meir et al. | |
| 9,622,542 | B2 | 4/2017 | Greene | |
| 9,655,407 | B2 | 5/2017 | Reinhardt et al. | |
| 2002/0178610 | A1 | 12/2002 | Cheng | |
| 2003/0148076 | A1 * | 8/2003 | Huang | B32B 7/04 428/196 |
| 2005/0153614 | A1 * | 7/2005 | Dohler | D05C 1/08 442/181 |
| 2005/0241181 | A1 | 11/2005 | Cheng | |
| 2005/0262734 | A1 | 12/2005 | Cheng | |
| 2005/0262735 | A1 | 12/2005 | Cheng | |
| 2009/0071041 | A1 * | 3/2009 | Hooper | A43B 7/06 36/3 A |
| 2009/0133287 | A1 | 5/2009 | Meschter | |
| 2010/0107442 | A1 * | 5/2010 | Hope | A43B 23/024 36/50.1 |
| 2011/0041359 | A1 * | 2/2011 | Dojan | A43B 23/025 36/47 |
| 2011/0237995 | A1 * | 9/2011 | Ota | A41D 13/0015 602/75 |
| 2011/0287212 | A1 * | 11/2011 | Miloslavsky | B32B 5/024 428/104 |
| 2012/0023778 | A1 | 2/2012 | Dojan et al. | |
| 2012/0198727 | A1 | 8/2012 | Long | |
| 2012/0324658 | A1 | 12/2012 | Dojan et al. | |
| 2013/0081307 | A1 * | 4/2013 | del Biondi | A43B 3/0036 36/83 |
| 2013/0139329 | A1 * | 6/2013 | Ferniani | A43B 7/08 12/128 R |
| 2013/0247417 | A1 | 9/2013 | Nurse et al. | |
| 2014/0020193 | A1 | 1/2014 | Dojan et al. | |
| 2014/0059883 | A1 | 3/2014 | Adeagbo et al. | |
| 2014/0157623 | A1 | 6/2014 | Dekovic | |
| 2014/0173934 | A1 | 6/2014 | Bell | |
| 2014/0238082 | A1 | 8/2014 | Meir | |
| 2014/0283411 | A1 | 9/2014 | Nabernik et al. | |
| 2014/0338222 | A1 * | 11/2014 | Song | A43B 23/0235 36/45 |
| 2014/0373389 | A1 | 12/2014 | Bruce | |
| 2015/0210034 | A1 | 7/2015 | Tarrier et al. | |
| 2015/0272272 | A1 | 10/2015 | Scofield | |
| 2015/0272274 | A1 * | 10/2015 | Berns | A43B 23/0205 36/84 |
| 2016/0213095 | A1 * | 7/2016 | Kohatsu | A43B 1/04 |
| 2016/0286898 | A1 | 10/2016 | Manz et al. | |
| 2016/0316855 | A1 | 11/2016 | Berns et al. | |
| 2016/0316856 | A1 | 11/2016 | Berns et al. | |
| 2016/0345675 | A1 * | 12/2016 | Bruce | A43B 23/0245 |
| 2016/0345677 | A1 | 12/2016 | Bruce et al. | |
| 2016/0345678 | A1 | 12/2016 | Mokos | |
| 2016/0353828 | A1 | 12/2016 | Chen | |
| 2017/0143076 | A1 | 5/2017 | Farris | |
| 2017/0156434 | A1 | 6/2017 | Tamm et al. | |
| 2017/0156439 | A1 | 6/2017 | Yoshida et al. | |
| 2017/0156445 | A1 | 6/2017 | Guest et al. | |
| 2017/0157846 | A1 | 6/2017 | Miller et al. | |
| 2017/0332722 | A1 | 11/2017 | Dealey et al. | |
| 2018/0116317 | A1 * | 5/2018 | Inoue | A41D 3/00 |

FOREIGN PATENT DOCUMENTS

| | | | |
|---|---|---|---|
| CN | 103989290 | | 8/2014 |
| FR | 2626201 | A1 | 7/1989 |
| GB | 1079731 | A | 8/1967 |
| JP | 06057613 | A | 3/1994 |
| JP | 08246323 | A | 9/1996 |
| JP | 2016195676 | A | 11/2016 |
| TW | 340310 | | 9/1998 |
| TW | 351073 | | 1/1999 |
| TW | 351670 | | 2/1999 |
| TW | 353601 | | 3/1999 |
| TW | 412939 | | 11/2000 |
| TW | 503275 | | 9/2002 |
| TW | 521584 | | 2/2003 |
| TW | M257116 | | 2/2005 |
| TW | M357218 | | 5/2009 |
| TW | M378896 | | 4/2010 |
| TW | M420202 | | 1/2012 |
| TW | M433118 | | 7/2012 |
| TW | M433121 | | 7/2012 |
| TW | M437635 | | 9/2012 |
| TW | M451012 | | 4/2013 |
| TW | M456105 | | 7/2013 |
| TW | M476494 | | 4/2014 |
| TW | M476496 | | 4/2014 |
| TW | M527445 | | 8/2016 |
| WO | 9003744 | A1 | 4/1990 |
| WO | 2015038243 | A1 | 3/2015 |
| WO | 2019/013983 | A1 | 1/2019 |

OTHER PUBLICATIONS

Paiho Sparta III Website, available at: http://www.paiho.com/index.php/en/menu-en-left-np-sparta (Nov. 3, 2015).

International Search Report and Written Opinion dated May 1, 2019 for Application No. PCT/US2019019481.

International Search Report and Written Opinion dated May 1, 2019 for Application No. PCT/US2019/019490.

International Search Report and Written Opinion dated May 13, 2019 for Application No. PCT/US2019/019486.

International Search Report and Written Opinion dated May 7, 2019 for Application No. PCT/US2019/019492.

Wikipedia, "Stitch (textile arts)" May 6, 2016 (Jun. 5, 2016), retrieved on Apr. 24, 2019 from https://en.wikipedia.org/w/index.php?title=Stitch_(textile_arts )&oldid=718918887.

* cited by examiner

ARTICLE WITH EMBROIDERED TAPE SEGMENTS

BACKGROUND

Embroidery is a traditional method of decorating, tailoring, mending, patching, or reinforcing textile materials by sewing with a needle and stitching material. Hand-embroidered goods date back as late as the Warring States period in China. During the industrial revolution, the invention of the sewing machine and dedicated embroidery machines expanded the use of the technique. Modern embroidery techniques may utilize machine-readable code to autonomously create an embroidery pattern on a sheet of textile materials. Textile materials include fabrics such as cotton, wool, or silk, as well as leather, foam, polymer sheets, and synthetic equivalents. On the textile materials, a number of stitch techniques (such as the chain stitch, the buttonhole or blanket stitch, the running stitch, the satin stitch, or the cross stitch) may be used depending on the purpose of the embroidery. The stitching techniques may be used in combination to form a variety of set patterns. The stitching patterns may be decorative; for example, the pattern may form a flower or series of flowers. Alternatively, the stitching may be structural, such as stitching along the edges of a garment to reinforce the seams. In further cases, the stitching may be both decorative and functional, such as the use of a floral pattern used to reinforce a patch.

Typically, a thread or yarn is used as the stitching material and stitched into the textile. Commonly, the thread or yarn may be made of cotton or rayon, as well as traditional materials like wool, linen, or silk. However, embroidery may also sew in dissimilar materials to the textile, usually for decorative purposes. For example, thread created out of precious metals such as gold or silver may be embroidered within more traditional fabrics such as silk. Additional elements (such as beads, quills, sequins, pearls or entire strips of metal) may be sewn in during embroidery. These elements may be sewn in along with yarn or thread using a variety of stitching techniques, depending on the desired placements of the elements.

SUMMARY

In one embodiment, a method of making an article includes embroidering a tape segment to attach the tape segment to a substrate layer, heating the tape segment so that the tape segment expands and forms a cushioned region along the substrate layer and forming the article using the substrate layer.

In another aspect, a method of making an article includes embroidering a thread to a backing layer to form a first embroidered region of an embroidered assembly, laying down a tape segment, embroidering the thread and the tape segment to the backing layer to form a second embroidered region of the embroidered assembly, removing the backing layer from the embroidered assembly and forming the article from the embroidered assembly.

In another aspect, an upper for an article of footwear includes a forefoot region, a midfoot region and a heel region, a continuous embroidered lattice structure, the embroidered lattice structure comprising a plurality of tape segments attached to one another by stitches and where the continuous embroidered lattice structure extends through the forefoot region, the midfoot region, and the heel region.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, with emphasis instead being placed upon illustrating the principles of the embodiments. Moreover, in the figures, like reference numerals designate corresponding parts throughout the different views.

DETAILED DESCRIPTION

The embodiments are related to the application of one or more tape segments to an article. As used herein, the term "article" refers broadly to articles of footwear, articles of apparel (e.g., clothing), as well as accessories and/or equipment. For the purposes of general reference, an article is any item designed to be worn by or on a user, or act as an accessory. In some embodiments, an article may be an article of footwear, such as a shoe, sandal, boot, etc. In other embodiments, an article may be an article of apparel, such as a garment, including shirts, pants, jackets, socks, undergarments, or any other conventional item. In still other embodiments, an article may be an accessory such as a hat, glove, or bag worn by the wearer.

Articles of footwear include, but are not limited to, hiking boots, soccer shoes, football shoes, sneakers, running shoes, cross-training shoes, rugby shoes, basketball shoes, baseball shoes as well as other kinds of shoes. Moreover, in some embodiments, components may be configured for various kinds of non-sports-related footwear, including, but not limited to, slippers, sandals, high-heeled footwear, loafers as well as any other kinds of footwear. Articles of apparel include, but are not limited to, socks, pants, shorts, shirts, sweaters, undergarments, hats, gloves, as well as other kinds of garments. Accessories include scarves, bags, purses, backpacks, as well as other accessories. Equipment may include various kinds of sporting equipment including, but not limited to, bats, balls, various sporting gloves (e.g., baseball mitts, football gloves, ski gloves, etc.), golf clubs, as well as other kinds of sporting equipment.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

Figure 1:
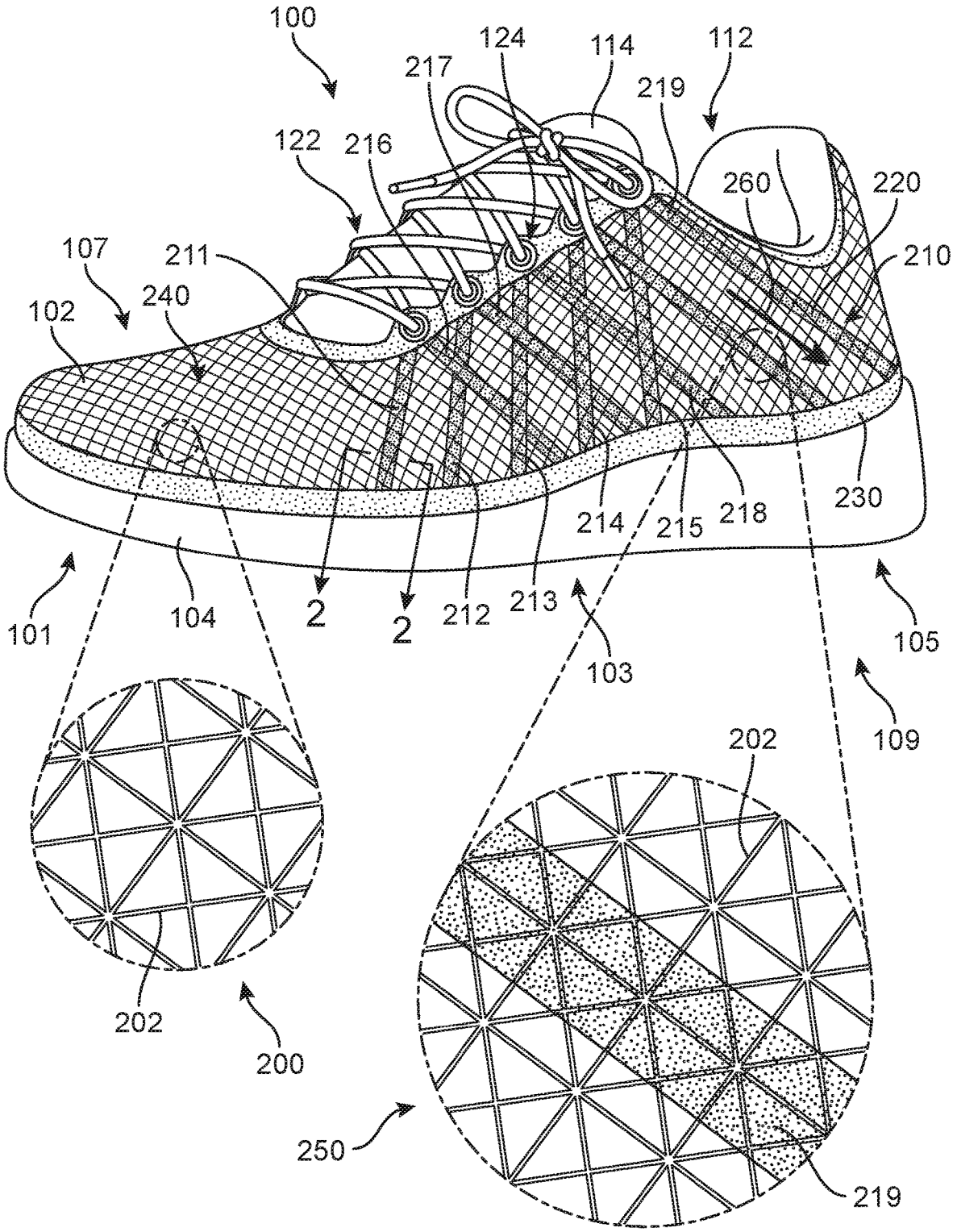
FIG. 1 is a schematic view of an embodiment of an article of footwear including embroidered tape segments.

For purposes of general reference, as illustrated in FIG. 1, article of footwear 100 may be divided into three regions: forefoot region 101, midfoot region 103, and heel region 105. Forefoot region 101 may be generally associated with the toes and joints connecting the metatarsals with the phalanges. Midfoot region 103 may be generally associated with the arch of a foot, including the instep. Likewise, heel region 105 or "hindfoot" may be generally associated with the heel of a foot, including the calcaneus bone. For purposes of this disclosure, the following directional terms, when used in reference to an article of footwear, shall refer to the article of footwear when sitting in an upright position, with the sole facing the ground, that is, as it would be positioned when worn by a wearer standing on a substantially level surface.

The term "longitudinal," as used throughout this detailed description and in the claims, refers to a direction extending along the length of a component. For example, a longitudinal direction of an article of footwear extends from forefoot region 101 to heel region 105 of article of footwear 100. The term "forward" or "front" is used to refer to the general direction in which the toes of a foot point, and the term "rearward" or "back" is used to refer to the opposite direction, i.e., the direction in which the heel of the foot is facing.

The term "lateral direction," as used throughout this detailed description and in the claims, refers to a side-to-side direction extending along the width of a component. In other words, the lateral direction may extend between medial side 107 and lateral side 109 of article of footwear 100, with lateral side 109 of the article of footwear 100 being the surface that faces away from the other foot, and medial side 107 being the surface that faces toward the other foot.

The term "vertical," as used throughout this detailed description and in the claims, refers to a direction generally perpendicular to both the lateral and longitudinal directions. For example, in cases where an article of footwear is planted flat on a ground surface, the vertical direction may extend from the ground surface upward. It will be understood that each of these directional adjectives may be applied to individual components of an article of footwear. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

It will be understood that the forefoot region, the midfoot region, and the heel region are only intended for purposes of description and are not intended to demarcate precise regions of an article of footwear. For example, in some cases, one or more of the regions may overlap. Likewise, the medial side and the lateral side are intended to represent generally two sides, rather than precisely demarcating an article of footwear into two halves. In addition, the forefoot region, the midfoot region, and the heel region, as well as the medial side and the lateral side, may also be applied to individual components of an article of footwear, including a sole structure, an upper, a lacing system, and/or any other component associated with the article.

Article of footwear 100 may include upper 102 and a sole or "sole structure" 104, which define an internal cavity between the upper and sole. The "interior" of an article of footwear refers to space in this internal cavity that is occupied by a wearer's foot when the article of footwear is worn. The "inner side" or "inside" of an element refers to the face of that element that is (or will be) oriented toward the internal cavity in a completed article of footwear. The "outer side," "outside," or "exterior" of an element refers to the face of that element that is (or will be) oriented away from the internal cavity in the completed article of footwear 100. In some cases, the inner side of an element may have other elements between that inner side and the interior in the completed article of footwear 100. Similarly, an outer side of an element may have other elements between that outer side and the space external to the completed article of footwear 100. Further, the terms "inward" and "inwardly" shall refer to the direction toward the interior of the article of footwear, and the terms "outward" and "outwardly" shall refer to the direction toward the exterior of article of footwear 100.

Upper 102 provides a covering for the wearer's foot that comfortably receives and securely positions the foot with respect to the sole structure. Upper 102 may be made from any suitable material or pluralities of materials including, but not limited to, nylon, cotton, natural leather, synthetic leather, natural rubber, or synthetic rubber. In general, upper 102 includes opening 112 that provides entry for the foot into an interior cavity of upper 102 in heel region 105. Upper 102 may be of a variety of styles depending on factors such as desired use and required ankle mobility. For example, an athletic shoe with upper 102 having a "low-top" configuration extending below the ankle that is shaped to provide high mobility for an ankle. However, upper 102 could be configured as a "high-top" upper extending above the wearer's ankle for basketball or other activities, or as a "mid-top" configuration extending to about the wearer's ankle. Furthermore, upper 102 may also include non-athletic shoes, such as dress shoes, loafers, sandals, and work boots. Upper 102 may also include tongue 114 that provides cushioning and support across the instep of the foot.

Upper 102 may also include other known features in the art including heel tabs, loops, etc. Furthermore, upper 102 may include a toe cage or box in the forefront region. Even further, upper 102 may include logos, trademarks, and instructions for care. Upper 102, and the components for upper 102, may be manufactured from conventional materials (e.g., woven or nonwoven textiles, leather, synthetic leather, rubber, polymer foams, etc.). The specific materials utilized are generally selected to impart wear resistance, flexibility, air-permeability, moisture control, and comfort to the article of footwear.

Upper 102 may include a fastening provision on a fastening region of the upper. For example, the fastening provision may be lacing system 122, or "lace," applied at a fastening region of upper 102. Other embodiments of fastening provisions, include, but are not limited to, laces, cables, straps, buttons, zippers as well as any other provisions known in the art for fastening articles. For a lacing system, the fastening region comprises plurality of eyelets 124 that may be disposed within an eyestay element. In other embodiments, the fastening region may comprise one or more tabs, loops, hooks, D-rings, hollows, or any other provisions known in the art for fastening regions.

Sole structure 104 is positioned between a foot of a wearer and the ground, and may incorporate various component elements. For example, sole structure 104 may include one or more of inner sole component or "insoles", a middle sole element or "midsole", and an outer sole element or "outsole". An insole may take the form of a sockliner adjacent the wearer's foot to provide a comfortable contact surface for the wearer's foot. It will be understood that an insole may be optional. Further, a midsole may directly serve as a cushion and support for the foot. In addition, an outsole may be configured to contact the ground surface.

Upper 102 and sole structure 104 may be coupled using any conventional or suitable manner, such as adhesion or bonding, via a woven connection, via one or more types of fasteners, etc. Additionally, in some embodiments, sole structure 104 and upper 102 may be combined together in a single unitary construction.

Sole structure 104 may contact a ground surface and have various features to deal with the ground surface. Examples of ground surfaces include, but are not limited to, indoor ground surfaces such as wood and concrete floors, pavement, natural turf, synthetic turf, dirt, as well as other surfaces. In some cases, the lower portions of sole structure 104 may include provisions for traction, including, but not limited to, traction elements, studs, and/or cleats.

Sole structure 104 may be made of a variety of any suitable material or pluralities of materials for a variety of functions. For example, one or more components of sole structure 104, such as the midsole, may be formed from a polymer foam (e.g., a polyurethane or ethylvinylacetate foam) material that attenuates ground reaction forces (i.e., provides cushioning) during walking, running, and other ambulatory activities. In addition, the components of a sole may also include gels, fluid-filled chambers, plates, moderators, inserts, or other elements that further attenuate forces, enhance stability, or influence the motions of the foot. In addition, the other components may have specific surface properties, such as an outsole being made from a durable material, such as carbon or blown rubber, which is further textured to impart traction. Furthermore, the insole may be made from a waterproof material such as a synthetic such as ethylvinylacetate to prevent moisture seeping into the sole.

Dissimilar materials described herein may be attached by fusing or welding. As utilized herein, the terms "fusing" and "welding" (and variants thereof) are defined as a securing technique between two elements that involves a softening or melting of the material of at least one of the elements such that the materials of the elements are secured to each other when cooled. Similarly, the term "weld" or variants thereof is defined as the bond, link, or structure that joins two elements through a process that involves a softening or melting of material within at least one of the elements such that the elements are secured to each other when cooled. Welding may involve the melting or softening of two components such that the materials from each component intermingle with each other, that is, the materials may diffuse across a boundary layer (or "heat-affected zone") between the materials, and are secured together when cooled. Alternatively, welding may involve the melting or softening of a material in a first component such that the material extends into or infiltrates the structure of a second component, for example, infiltrating crevices or cavities in the second component or extending around or bonding with filaments or fibers in the second component to secure the components together when cooled. Thus, welding of two components together may occur when material from one or both of the components melts or softens. Accordingly, a weldable material, such as a polymer material, may be provided in one or both of the components. Additionally, welding does not generally involve the use of stitching or adhesives, but involves directly bonding components to each other with heat. In some situations, however, stitching or adhesives may be utilized to supplement the weld or the joining of the components through welding. Components that have been welded together will be understood to be "fused" together.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" shall refer to the joining of two components in a manner such that the two components are secured together, but may be readily detached from one another. Examples of removable attachment mechanisms may include hook and loop fasteners, friction fit connections, interference fit connections, threaded connectors, cam-locking connectors, and other such readily detachable connectors. Similarly, "removably disposed" shall refer to the assembly of two components in a non-permanent fashion.

The term "strand" includes a single fiber, filament, or monofilament, as well as an ordered assemblage of textile fibers having a high ratio of length to diameter and normally used as a unit (e.g., slivers, roving, single yarns, plies yarns, cords, braids, ropes, etc.). The term "thread" as used herein may refer to strands used for stitching.

The embodiments discuss methods of embroidering or sewing one or more elements to a substrate. Embroidering an element to a substrate comprises stitching the element in place with a thread, yarn, or other strand of material.

In some embodiments, one or more tape segments may be embroidered into place along a substrate. Tape segments may be comprised of various kinds of materials. In some cases, tape segments may be comprised of polymer materials with different material properties from threads or collections of threads (e.g., embroidered elements). Tape segments may also be seen to have a width that is substantially greater than the thickness, and where the length is substantially greater than both the width and thickness.

In different embodiments, the dimensions of one or more tape segments could vary. For example, the thickness of a tape segment could vary in a range between approximately 0.01 millimeters and 10 millimeters. As another example, the width of a tape segment could vary in a range between approximately 0.1 millimeters and 10 millimeters. The length of the segment of tape may generally vary according to the particular pattern or design for an article and may generally be substantially greater than 1 millimeter.

The material of one or more tape segments may vary. In some embodiments, the material may be of a polymer material of varying hardness such as polyvinyl acetate (PVA), thermoplastic polyurethane (TPU), polyethylene, or ethylene vinyl acetate (EVA). In some embodiments, the tapes may be a blend of a polymer material with an additive such as nitrile rubber, such as an EVA blend with nitrile rubber. In some embodiments, the tapes may be made of a blend material such that the hardness may be controlled by the relative blend of nitrile rubber. In other embodiments, the relative hardness may be controlled by controlling the relative weight of the tapes from materials including PVA, TPU, and/or EVA as well as nitrile rubber. In some embodiments, tapes could comprise a fabric material. In various embodiments, the tapes may be made from a foam. In still other embodiments, the tapes could be comprised of a film. In still other embodiments, tapes could be composite with multiple layers—including polymer layers and fabric layers, for example.

As discussed in further detail below, in some embodiments, tapes could be made of materials that expand under heat and/or pressure. Exemplary expanding materials include foam materials, expanding polymers, expanding films, and/or other expandable materials.

In some embodiments, tapes could be formed of a hot melt material that melts under heat and/or pressure. Exemplary materials that may be used as part of a hot melt material include, but are not limited to, ethylene-vinyl acetates, polyolefins, polyamides and polyesters, polyurethanes, styrene block copolymers, polycarbonates, fluoropolymers, silicone rubbers, etc. In some embodiments, a hot melt material could include, or consist of, thermoplastic polyurethane (TPU). Moreover, it may be appreciated that a hot melt material could comprise various combinations of the materials listed here, as well as combinations with still other materials. The specific materials used may be selected to achieve desired properties, such as a desired glass transition temperature, degree of crystallization, melt viscosity, crystallization rate, desired level of tackiness, color, resistance to water or other solvents, as well as possibly other factors.

It may be appreciated that a hot melt material can be used as an adhesive in some cases, or as a compound that can be molded with heat in other cases. For example, in some embodiments, a hot melt can be used to form various structural elements by melting tape segments into a desired geometry and cooling the hot melt.

Threads used for embroidery may be used from a variety of materials. For example, thread may be made of polymer materials including nylon, polyethylene, TPU, PVA, or EVA as well as Dyneema fiber made from Ultra-High Molecular Weight Polyethylene. Thread may also include a blend of polymer materials and may include nitrile rubber. Thread may be also made from more conventional materials including cotton, silk, or other natural fibers disclosed herein. Other materials that may be used include, but are not limited to, nylon, polyester, polyacrylic, polypropylene, polyethylene, metal, silk, cellulosic fibers, elastomers, etc. Thread may also be made from any known synthetic equivalent. In some embodiments, exposing the thread to heat or pressure may cause the thread to melt or fuse. In other embodiments, exposing the thread to heat or pressure may cause the thread to dissolve. In still other embodiments, the thread may dissolve when exposed to a solvent, such as acid or water.

In some embodiments, threads may be comprised of a material that stretches lengthwise under tension. For example, in some embodiments, a thread could be an elastic thread. As an example, an elastic thread comprised of 60-70% polyester and 30-40% polyurethane could be used.

The materials of the articles herein may vary. In some embodiments, articles may include one or more knitted, woven, or non-woven fabric layers. In some embodiments, the textile is a fabric made of material such as silk, wool, or cotton. In other embodiments, the textile is made of synthetic equivalents, such as polyvinyl acetate (PVA), thermoplastic polyurethane (TPU), or ethylene vinyl acetate (EVA). In general, a fabric comprises a series of yarns, fibers, filaments, or strands in a networked pattern made by weaving, knitting, spreading, crocheting, or bonding the yarns, fibers, filaments or strands together. In still other embodiments, the textile may be leather, foam, synthetic equivalents of leather, or single sheet materials such as plastic or vinyl sheets. In other embodiments, an article may not include any knitted, woven, and/or non-woven fabric layers and instead may comprise only a self-supporting embroidered structure, which is discussed below.

Some embodiments may utilize one or more backing layers. The materials of backing layers may vary. Backing layers or sheets may be used as an anti-abrasion layer, and may be made of a material soft to the skin, such as silk or cotton, as well as synthetic-like equivalents such as nylon, or foam materials. Backing layers may be used to prevent an article from stretching during embroidery, and may be used from a harder more rigid substance, such as a sheet made from TPU, PVA, or EVA. Backing layers may also be made from a fusible material such as EV, or a dissolvable material such as TPU, PVA, or EVA. Furthermore, backing layers may combine various materials for different purposes for different sections. For example, a rigid dissolvable backing material may be used in combination with a soft permanent backing layer.

Differing embodiments may utilize differing substrate layers. In some embodiments, the substrate layer is an article of apparel. In other embodiments, the substrate layer is an article of footwear. In further embodiments, the substrate layer is for an accessory. In yet additional embodiments, the substrate layer is a backing layer. In some embodiments, the substrate layer is merely a portion of an article of apparel, article of footwear, accessory, and/or backing layer.

As seen in FIG. 1, article of footwear 100 is comprised of an upper including one or more embroidered regions. An embroidered region may comprise threads stitched to another layer (e.g., a substrate). In some embodiments, an embroidered region may comprise a standalone structure of threads that have been stitched together to form an interlocking matrix. The embroidered regions and/or structures of the present disclosure may utilize any of the structures, patterns, or features disclosed in Berns et al., U.S. Publication Number 2015/0272274, published on Oct. 1, 2015, filed on Mar. 25, 2015 as U.S. application Ser. No. 14/668,935, and titled "Footwear Including Textile Element," the entirety of which is herein incorporated by referenced and referred to as the "Embroidered Structures Application."

As discussed in the Embroidered Structures Application, some embodiments may incorporate self-supporting embroidered structures with threads or yarns arranged in a matrix that lacks a backing or support layer. Such embroidered structures could be formed by first stitching threads to a backing layer and later removing the backing layer. The embodiments can use any of the methods for forming embroidered structures as disclosed in the Embroidered Structures Application.

Referring to FIG. 1, upper 102 includes first embroidered region 200. This first embroidered region 200 may be comprised of threads 202 (or yarns) that have been arranged into a matrix. This matrix may be a self-supporting, embroidered structure including a plurality of interlocking threads (or yarn) or rows oriented in predetermined directions. In some cases, first embroidered region 200 may further be comprised of one or more crossing yarns (or binding yarns) oriented in a predetermined pattern.

Embodiments can include provisions for strengthening portions of an upper comprised of one or more embroidered regions. Some embodiments could include one or more tape segments attached to one or more layers of an upper. In some embodiments, one or more tape segments may be embroidered, or otherwise stitched, into place on an upper.

As seen in FIG. 1, upper 102 may include plurality of tape segments 210. Specifically, upper 102 includes first tape segment 211, second tape segment 212, third tape segment 213, fourth tape segment 214, fifth tape segment 215, sixth tape segment 216, seventh tape segment 217, eighth tape segment 218, ninth tape segment 219, and tenth tape segment 220. Although not visible in FIG. 1, article of footwear 100 may also include a corresponding set of tape segments on an opposing side of upper 100 (i.e., on medial side 107).

In different embodiments, a tape segment could be arranged in any manner on an upper or other article. In the exemplary embodiment, each tape segment generally extends diagonally from lower periphery 230 of upper 102 to a region adjacent plurality of eyelets 124, with the tape segments generally alternating in their respective orientations. In still other embodiments, tape segments could extend in any other direction along an upper. In other embodiments, tape segments may be arranged in an approximately straight path, while in other embodiments tape segments could be arranged in curved paths.

As seen in FIG. 1, plurality of tape segments 210 may be fixed in place along upper 102 using embroidery stitches. As an example, the enlarged view of second embroidered region 250 in FIG. 1, as well as in the cross-sectional view of FIG. 2, threads 202 may cross over, under and through ninth tape segment 219. In other words, in the configurations of FIGS. 1-2, plurality of tape segments 210 may be embedded within the broader embroidered structure 240 formed by threads 202.

Relative to first embroidered region 200, which lacks any reinforcing tape segments, second embroidered region 250 may be configured to resist stretching along direction 260 aligned with the orientation of ninth tape segment 219. Likewise, upper 102 is configured to resist stretching locally in regions adjacent the remaining tape segments and in directions parallel with the orientations of these tape segments.

Figure 2:
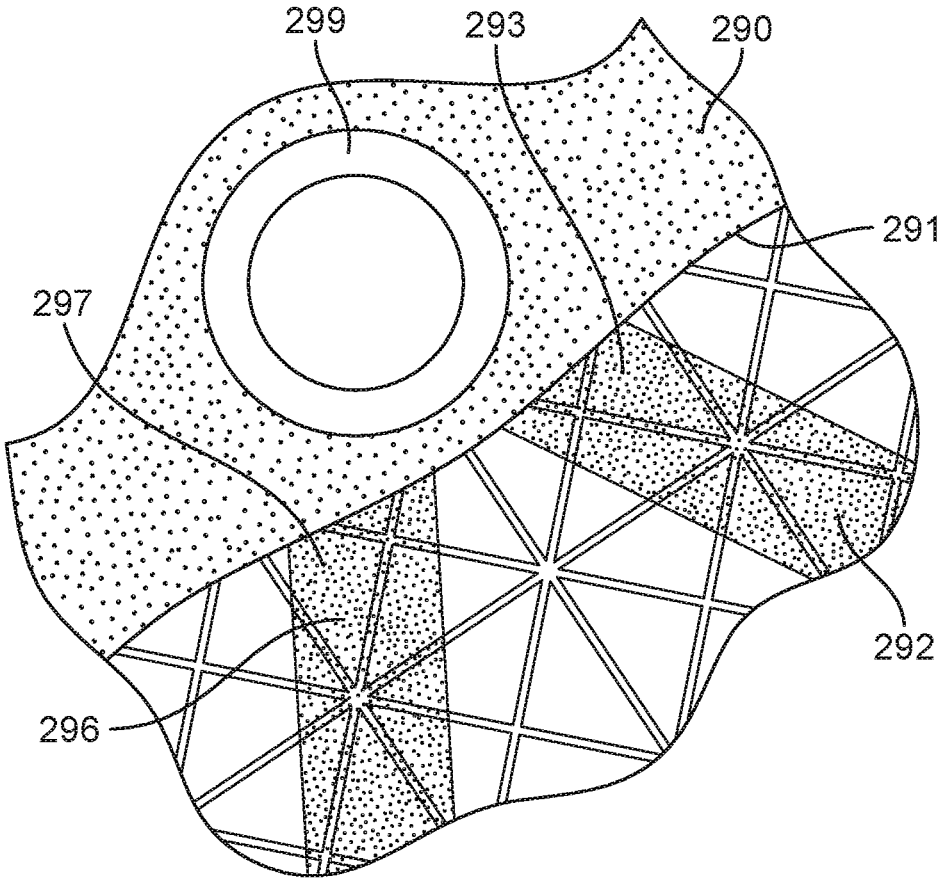
FIG. 2 is an enlarged view of a portion of an article including embroidered tape segments extending to an eyelet, according to an embodiment.

The exemplary embodiment uses tape segments to help transfer tension from eyelets of upper 102 to lower periphery 230 of upper 102. Specifically, as seen in FIG. 2, each tape segment has an end that may connect to eyestay element 290 of upper 102. For example, tape segment 296 includes end 297 that is fixed at periphery 291 of eyestay element 290 and directly adjacent eyelet 299. Likewise, tape segment 292 includes end 293 that is fixed at periphery 291 of eyestay element 290 and directly adjacent eyelet 299. With this arrangement, as a lace pulls on eyelet 299, tension is directed from eyelet 299 to eyestay element 290 and then directly to tape segment 296 and tape segment 292. These tape segments further transfer the tension to lower periphery 230 (see FIG. 1) and help prevent upper 102 from stretching in the region between eyestay element 290 and lower periphery 230. This may help better secure upper 102 around the foot when article of footwear 100 is worn.

Figure 3:
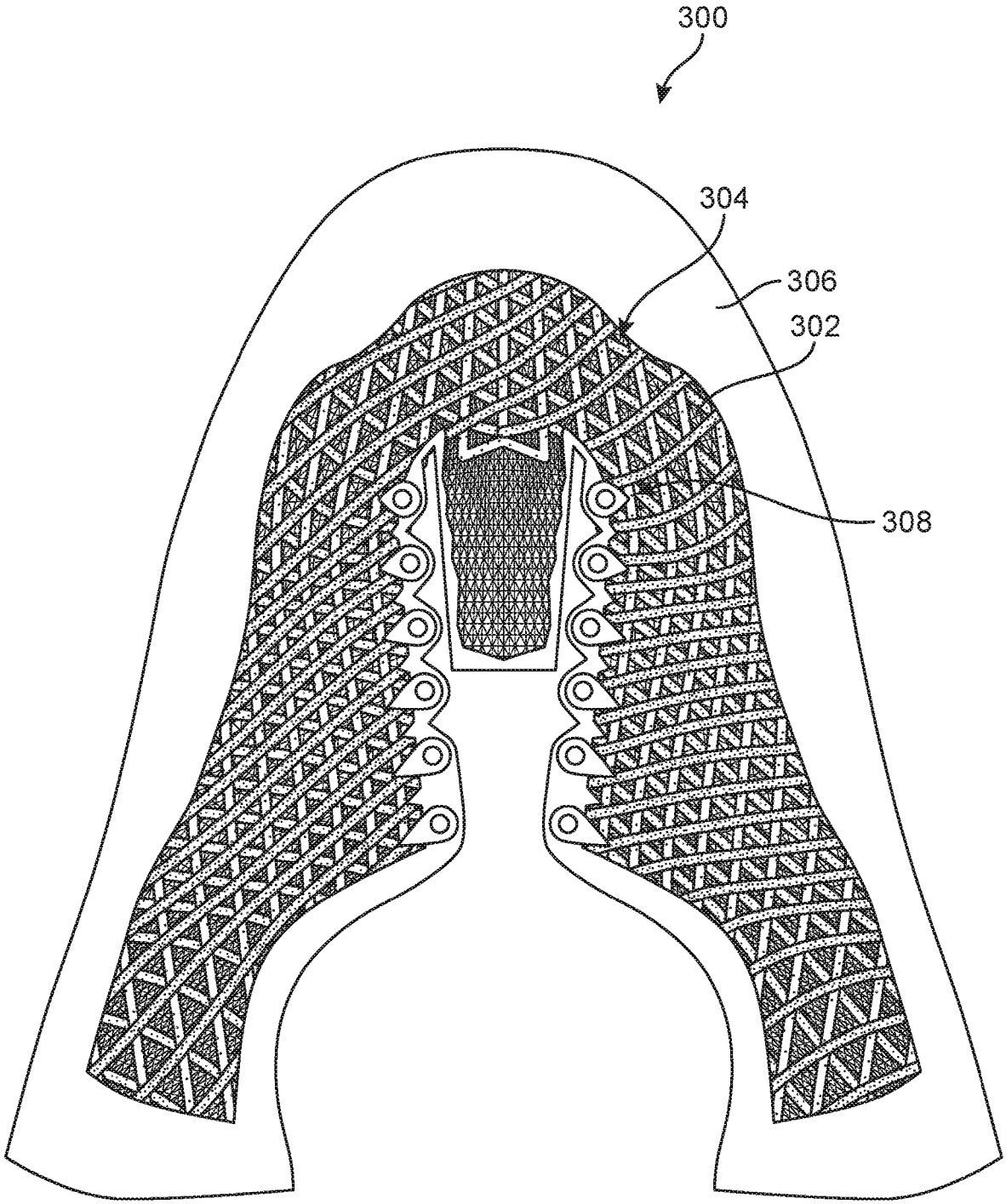
FIG. 3 is a schematic top down view of an embodiment of an article.
Figure 4:
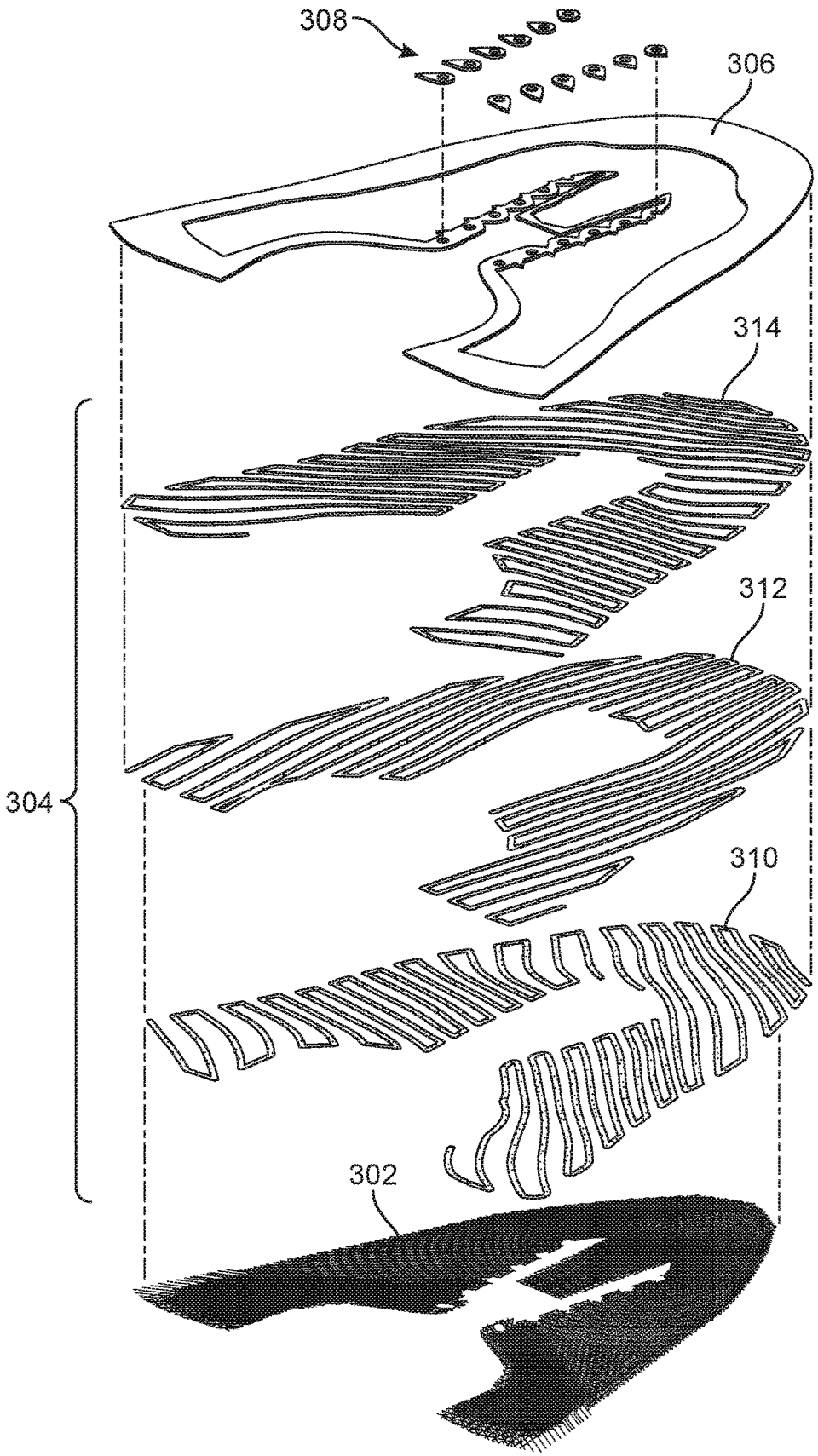
FIG. 4 is an exploded isometric view of various layers comprising the article of FIG. 3.

FIGS. 3 and 4 illustrate a schematic top down view, and an exploded isometric view, respectively, of an embodiment of a footwear upper, according to an embodiment. Referring to FIGS. 3-4, upper 300 includes a self-supporting embroidered layer 302, three tape layers 304, a peripheral layer 306 and a plurality of eyelets 308. Tape layers 304 further comprise a first tape layer 310, a second tape layer 312 and a third tape layer 314. In some embodiments, this structure may be formed as follows: first, embroidered layer 302 may be formed by embroidering thread onto a backing layer (not shown). Next, each tape layer may be laid down sequentially. In some embodiments, tape layers could be attached by applying embroidery stitches along the length of the tape, or at discrete locations along the tape (such as at crossing points between various tape layers). The embroidery stitches may secure the tape layers to the self-supporting embroidered layer 302, to adjacent tape layers and/or to a backing layer (which may be removed at the end of the manufacturing process). In other cases, one or more portions of tape could be attached to the embroidered layer 302 and/or to adjacent layers by other means, such as adhesives, welding (e.g., ultrasonic welding), etc. Once the tape layers have been secured, peripheral layer 306 may be formed by filling in the periphery of the assembly (i.e., embroidered layer 302, tape layers 304 as well as an optional backing layer) with an embroidered structure. Finally, plurality of eyelets 308 may be embroidered in place over the assembled layers. In some cases, other features, such as a logo, could also be embroidered atop one or more other layers.

In different embodiments, tape segments could be attached on an outer surface of a self-supported embroidery layer, while in other embodiments tape segments could be attached on an inner surface of a self-supported embroidery layer. This allows tape segments to be placed along the exterior surface of an article (e.g., an upper or an article of clothing) and/or along the interior surface of an article (e.g., an upper or an article of clothing). Moreover, in other embodiments the tape could be laid down against a backing layer and a self-supporting embroidered layer could be formed such that as it is formed, the tape segments are integrated into the embroidered layer.

Figure 5:
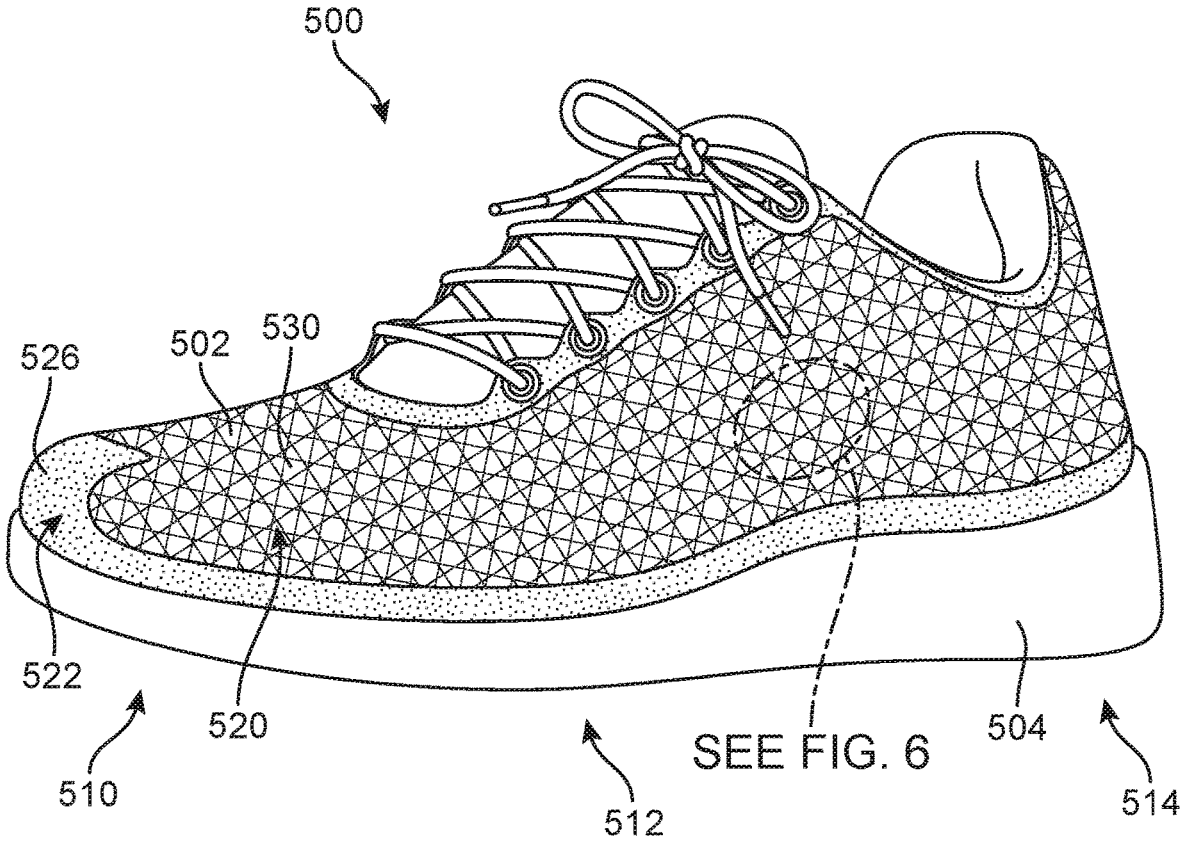
FIG. 5 is a schematic isometric view of a portion of an article of footwear including a continuous embroidered lattice structure, according to an embodiment.

FIG. 5 is a schematic isometric view of another embodiment of article 500. Referring to FIG. 5, article 500 may include some of the same provisions to article of footwear 100. In particular, article 500 is comprised of upper 502 and sole 504. Additionally, article 500 includes forefoot region 510, midfoot region 512, and heel region 514.

Upper 502 is comprised of lattice region 520 and a peripheral region 522. Lattice region 520 may be comprised of continuous embroidered lattice structure 530. Peripheral region 522 may differ in structure from lattice region 520. In some cases, peripheral region 522 could comprise a dense embroidered structure 526. In some cases, embroidered structure 526 may be a filled structure, comprising, in some cases, a satin stitch to form a dense embroidered region. In other embodiments, however, peripheral region 522 could be a knit structure. In some embodiments, continuous embroidered lattice structure 530 could overlap with peripheral region 522 such that embroidered structure 526 is disposed over (outwardly of) continuous embroidered lattice structure 530. Alternatively, in other embodiments, the peripheral region may be comprised of any other woven or non-woven fabric, textile, or other material.

In different embodiments, a continuous embroidered lattice structure may extend through one or more regions of an article. In some embodiments, a continuous embroidered lattice structure may extend through a forefoot portion of an article. In other embodiments, a continuous embroidered lattice structure may extend through a midfoot portion of an article. In still other embodiments, a continuous embroidered lattice structure may extend through a heel portion of an article. In some embodiments, a continuous embroidered lattice structure could extend through a forefoot portion, a midfoot portion, and a heel portion. In the exemplary embodiment shown in FIG. 5, continuous embroidered lattice structure 530 extends through forefoot region 510, midfoot region 512, and heel region 514 of upper 502. In some embodiments, continuous embroidered lattice structure 530 may extend through a substantial majority of the surface area of upper 502. This arrangement may provide a lightweight structure for a majority of upper 502 to help reduce weight. Moreover, this arrangement may provide manufacturers with the ability to assemble the majority of an upper from tape segments that can be precisely sized and positioned, therefore, reducing the amount of excess material used in the manufacturing of the upper.

Figure 6:
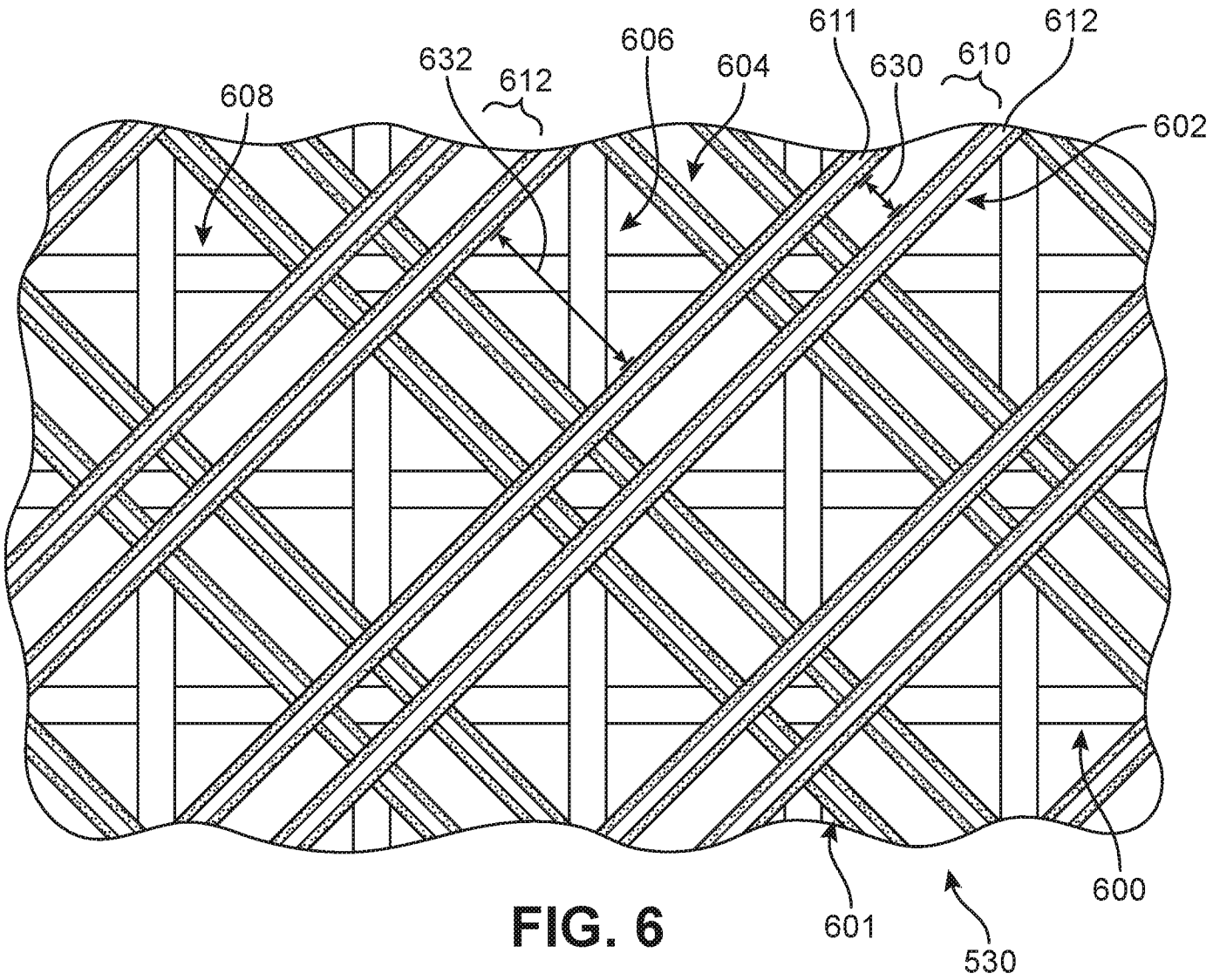
FIG. 6 is a schematic enlarged view of a portion of the continuous embroidered lattice structure of FIG. 5.
Figure 7:
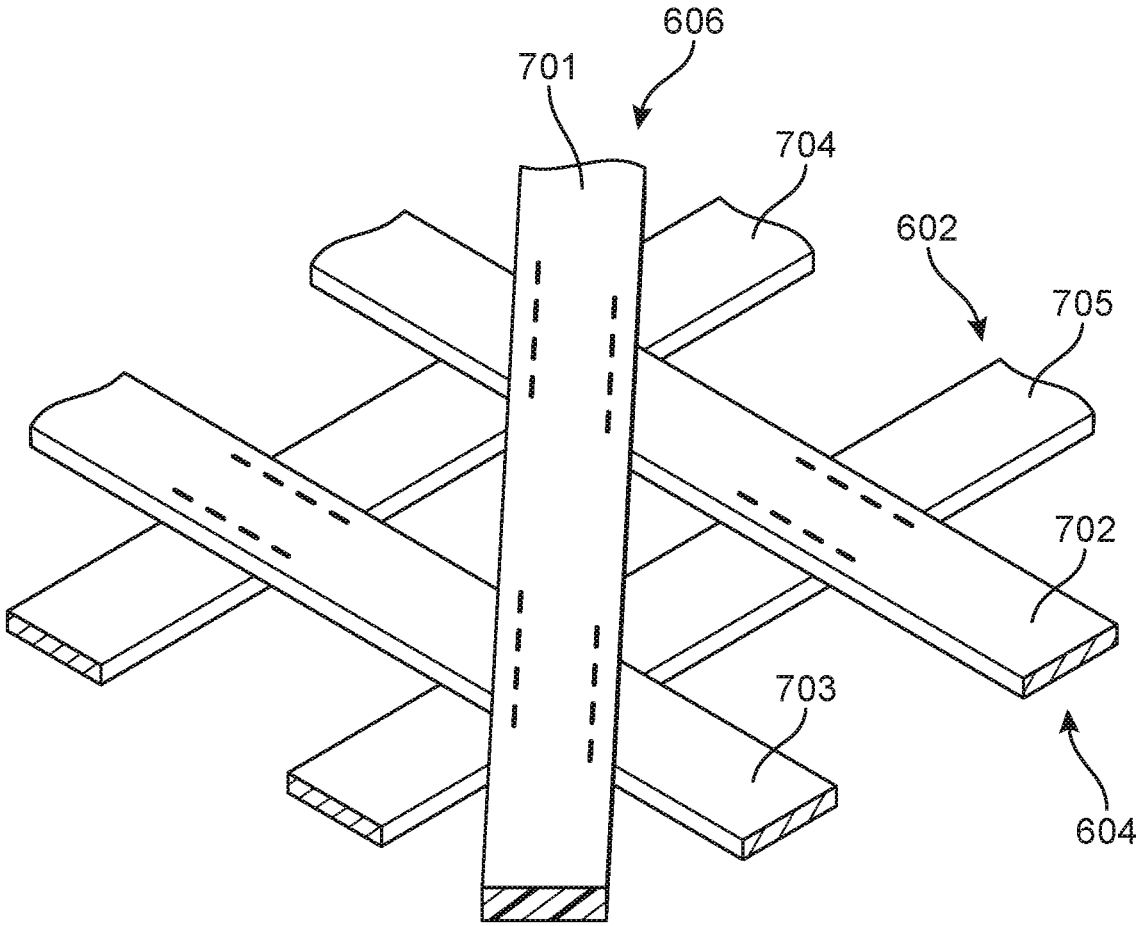
FIG. 7 is a schematic isometric view of an embodiment of several tape segments arranged into an embroidered lattice structure.

As seen in FIGS. 6 and 7, continuous embroidered lattice structure 530 may be comprised of plurality of tape segments 600 and a plurality of ribbon segments 601 arranged into a lattice geometry. In the present embodiment, tape segments 600 are comprised of a first material and ribbon segments 601 are comprised of a second material. Specifically, in some cases, tape segments 600 may be comprised of a polymer material or nonwoven material while ribbon segments 601 are an embroidered structure formed using two running satin stiches.

The lattice geometry may be characterized by various sets of parallel segments (both tape and ribbon segments). Specifically, first set of parallel ribbon segments 602 are all oriented in a first direction. Moreover, these ribbon segments are arranged with an alternating spacing. As seen in FIG. 6, first pair of ribbon segments 610 comprises first ribbon segment 611 and second ribbon segment 612 spaced apart from one another by first spacing 630. First pair of ribbon segments 610 is itself spaced apart from second pair of ribbon segments 614 by second spacing 632 that is larger than first spacing 630.

A second set of parallel ribbon segments 604 are all oriented in a second direction. In some embodiments, the second direction may be perpendicular to the first direction. Like first set of parallel ribbon segments 602, second set of parallel ribbon segments 604 are all parallel with one another and spaced in an alternating configuration that is similar to the spacing in first set of parallel ribbon segments 602.

First set of parallel tape segments 606 are oriented along a third direction. The third direction may be generally diagonal to the first direction and the second direction. Additionally, second set of parallel tape segments 608 are oriented along a fourth direction. Here, the third and fourth directions may be perpendicular to one another and each of these directions may be diagonally arranged with respect to the first and second directions. Unlike the two sets of parallel ribbon segments, the spacing between adjacent tape segments may be constant in some cases.

As best seen in FIG. 7, the tape and ribbon segments are stacked in a vertical direction with second set of parallel ribbon segments 604 disposed between set of parallel tape segments 606 and first set of parallel ribbon segments 602.

In some embodiments, these tape segments may be attached by one or more embroidered threads. As best seen in FIG. 7, tape segment 701 is stitched directly to ribbon segment 702 and ribbon segment 703. Likewise, ribbon segment 702 and ribbon segment 703 are both stitched to ribbon segment 704 and ribbon segment 705. This stitched arrangement may create a self-supporting embroidered lattice structure that may form a portion of an upper or other article.

Of course, the embodiment shown in FIGS, 5-7 is only intended to be an example of a self-supporting structure that can be formed using tape and ribbon segments that have been embroidered together. In general, tape and/or ribbon segments could be arranged in a variety of different patterns including, but not limited to, lattice patterns, grid patterns, web-like patterns, various mesh patterns as well as any other kinds of patterns. The type of pattern, including characteristics such as the spacing between adjacent tape segments, the sizes of tape segments (length, width, and thicknesses), and the relative arrangements of tape segments (stacked, woven, etc.), can be varied to achieve particular characteristics for the resulting structure including particular strength, flexibility, durability, weight, etc.

Embodiments can include provisions for increasing cushioning and/or comfort in one or more regions of an article. In some embodiments, an article may be configured with one or more cushioned regions. In some cases, the cushioned regions could be comprised of expanded tape segments that have been expanded during a manufacturing process.

Figure 8:
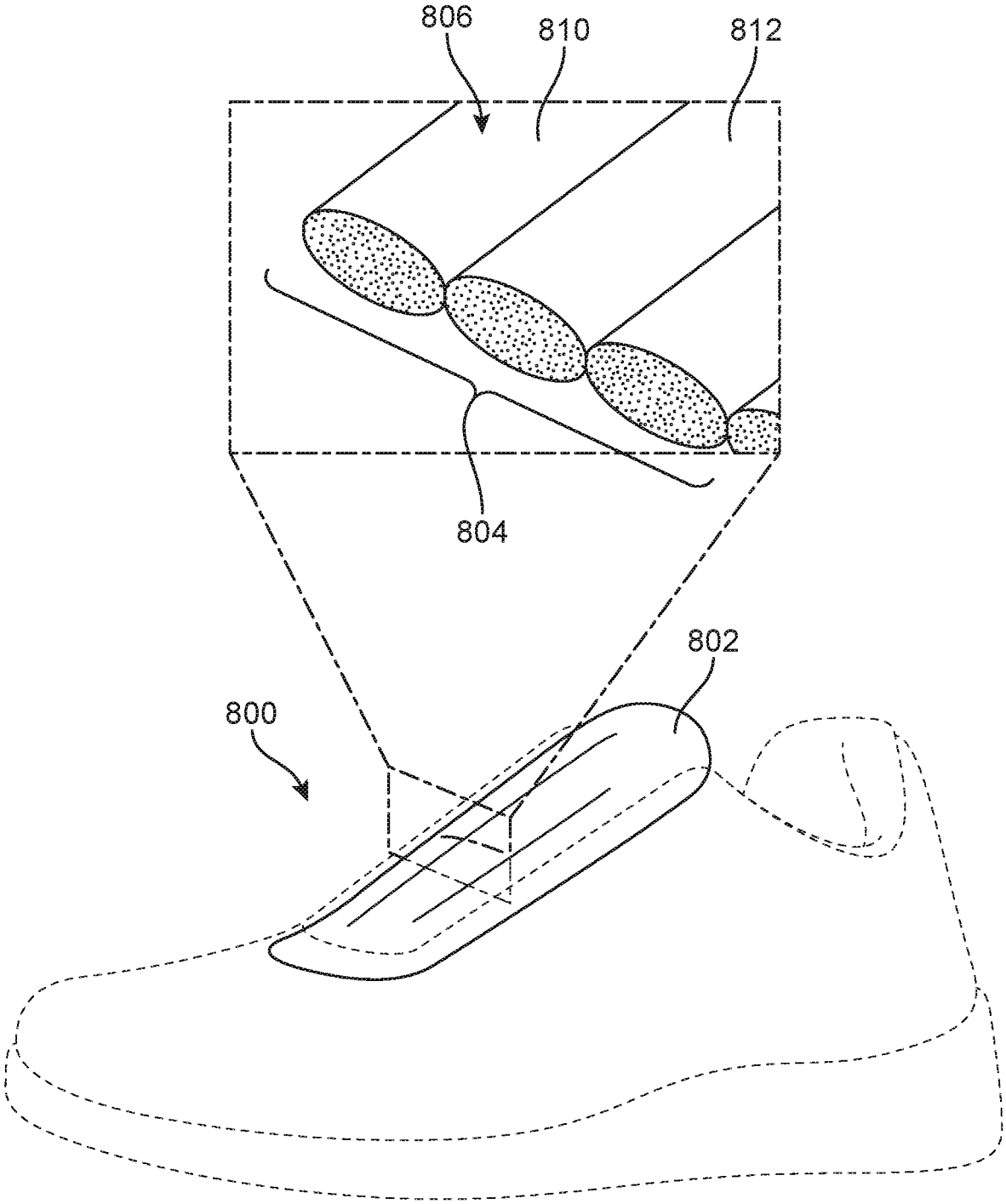
FIG. 8 is a schematic isometric view of an article including a cushioning region, according to an embodiment.

FIG. 8 is a schematic isometric view of article 800 in which tongue 802 is highlighted for purposes of clarity. Article 800 could be any kind of article and in some cases may share similar features to either article of footwear 100 and/or article 500 described above and shown in FIGS. 1 and 5, respectively. In some embodiments, portions of article 800 may comprise embroidered tape segments and/or other embroidered structures.

Referring to FIG. 8, tongue 802 may incorporate cushioning region 804. Moreover, cushioning region 804 may itself be comprised of individual expanded tape segments 806. These include, for example, first expanded tape segment 810 and second expanded tape segment 812.

In some embodiments, a cushioned region could comprise distinct expanded tape segments. However, in other embodiments, a cushioned region could comprise a monolithic structure without distinct expanded tape segments. In such cases, upon expansion, tape segments could fuse together to form a continuous structure in the cushioning region.

Although the exemplary embodiment depicts expanded tape segments arranged in a side-by-side manner to form a continuous cushioned region, other embodiments could include tape segments arranged in any other patterns, including the lattice pattern described above and shown in FIGS. 5-7. Thus, some embodiments could include continuous embroidered lattice structures where at least some portions of the lattice structure are comprised of expanded tape segments that form a cushioned region, such as in the tongue, the collar, etc.

Tapes can be attached to substrate materials using any of the principles, methods, systems, and teachings disclosed in any of the following applications: Berns et al., U.S. Publication Number 2016/0316856, published Nov. 3, 2016 and titled "Footwear Upper Including Strand Layers"; Berns et al., U.S. Publication Number 2016/0316855, published Nov. 3, 2016 and titled "Footwear Upper Including Variable Stitch Density"; and Berns et al., U.S. Publication Number 2015/0272274, published Oct. 1, 2015 and titled "Footwear Including Textile Element," the entirety of each application being herein incorporated by reference. Embodiments can use any known systems and methods for feeding tape to an embroidery or sewing machine including any of the systems and/or methods described in Miyachi et al., U.S. Pat. No. 5,673,639, issued Oct. 7, 1997 and titled "Method of feeding a piece of tape to a belt loop sewing machine and tape feeder for effecting same," the entirety of which is herein incorporated by reference.

Figure 9:
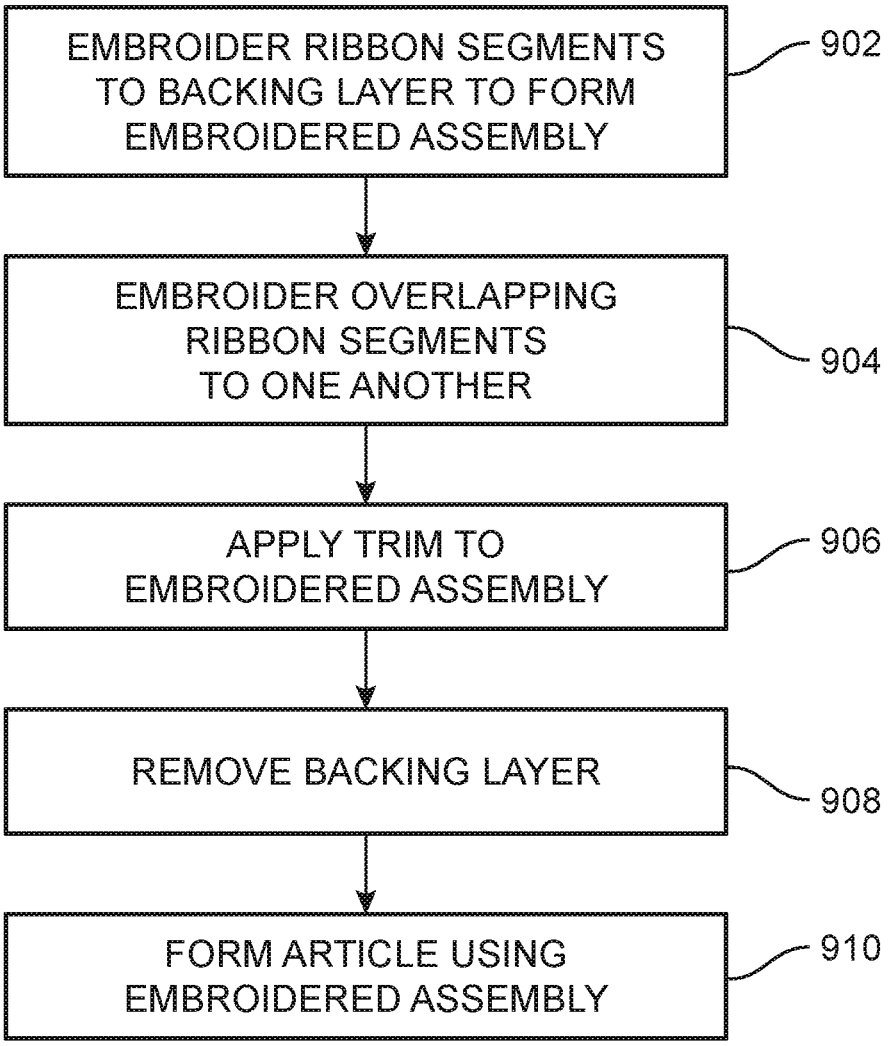
FIG. 9 is a schematic view of a process for forming an article, according to an embodiment.

FIG. 9 is a schematic view of a process for manufacturing an article according to an embodiment. Some of the steps of FIG. 9 are depicted schematically in FIGS. 10-12.

In first step 902, one or more tape segments may be embroidered to a backing layer to form an embroidered assembly. In some cases, each tape segment could be embroidered directly to the backing layer. The resulting embroidered assembly could comprise a self-supporting embroidered structure incorporating one or more tape segments. In cases where one or more tape segments overlap, the overlapping tape segments could be embroidered to one another, as in step 904.

Next, in step 906, a trim layer may be applied to one or more regions. In some embodiments, trim could be applied around the entire periphery of an embroidered structure, which may help secure the ends of the embroidered threads and create a self-supporting structure. In some embodiments, the trim could be formed by a knitting process, a weaving process, or any other kind of process. In some embodiments, separate trim elements could be secured using an adhesive along the periphery of the embroidered structure. Optionally, in other embodiments, no trim layer may be formed.

In step 908, a backing layer may be removed, leaving only the embroidered structure.

In step 910, the embroidered structure could be formed into an article. For example, if the article is an article of footwear, the embroidered structure could be placed on a last and assembled into a 3D upper. Following this, the structure could be attached to one or more sole elements. A lace could also be inserted through one or more eyelets in the article.

Figure 10:
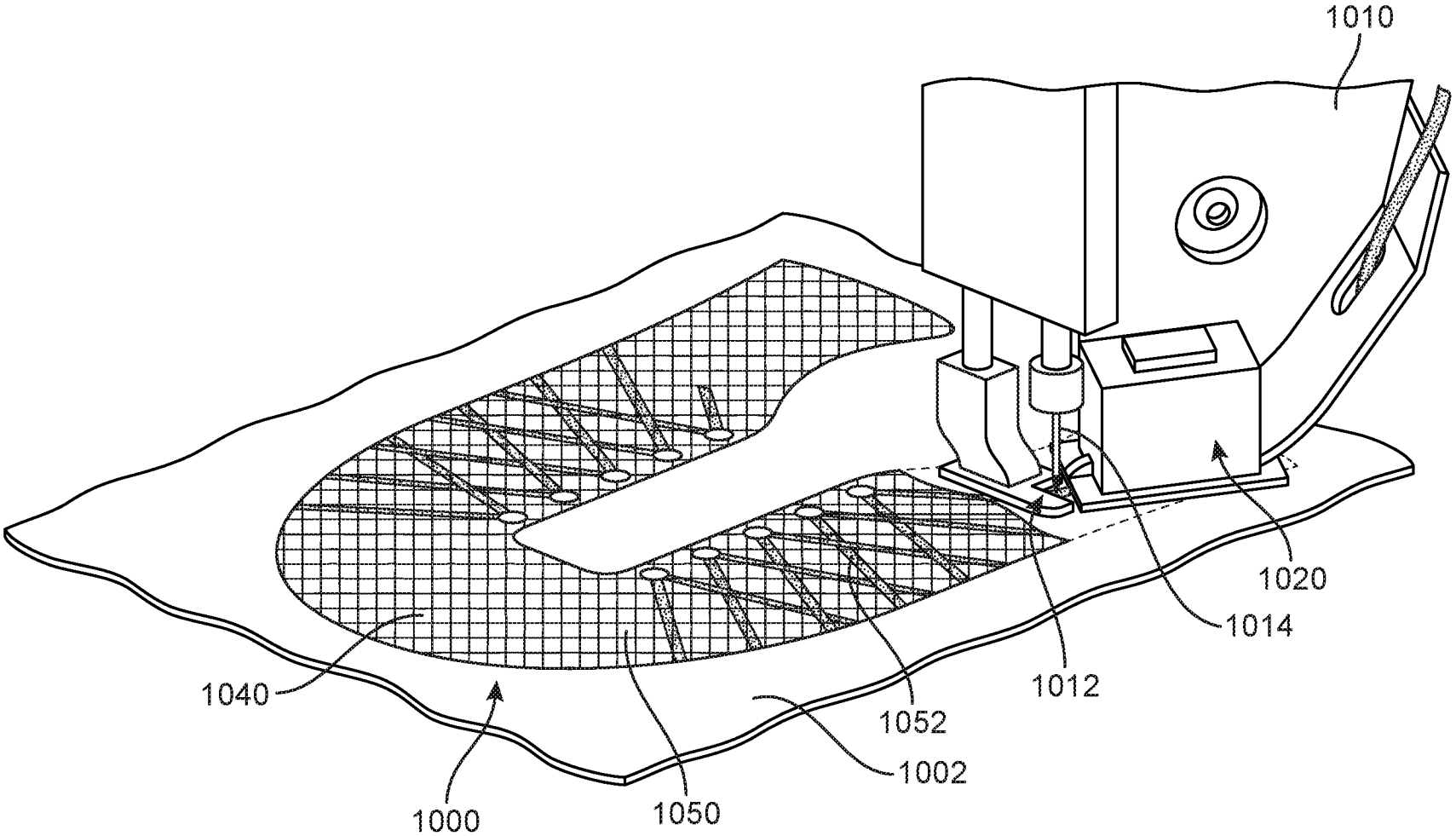
FIG. 10 is a schematic view of part of a process for forming an article, according to an embodiment.

FIG. 10 demonstrates an exemplary embodiment of part of a method of embroidering tape along an article. In some embodiments, the article may be an article of footwear, or an element of an article of footwear, such as the upper. In other embodiments, the article may be a garment or clothing, such as pants, socks, shirts, jackets, dresses, skirts, underwear, brassieres, supportive athletic garments, shorts, vests, or any other form of clothing known in the art. In still other embodiments, the article may be an accessory such as hats, gloves, and bags, or any other accessory known in the art that is worn by a user. In yet another embodiment, a backer plate may be used to form the outline of the article. In the specific illustrated example of FIG. 10, article 1000 is an upper for an article of footwear.

Referring to FIG. 10, backing layer 1002 may be positioned adjacent embroidery device 1010. Embroidery device 1010 may be any kind of embroidering device known in the art that may be suitable for constructing articles with embroidered regions, including the self-supporting embroidered structures described previously. Embroidery device 1010 may include needle assembly 1012 with needle 1014 that is controlled to place stitches into backing layer 1002.

A backing layer, or backer layer, may be used during the embroidery process. A backing layer, in general provides a layer to which one or more elements may be stitched. In some embodiments, a backing layer may remain after manufacturing to provide, for example, an inner liner for an article. In some embodiments, the backing layer may be melted into the article. In other embodiments, a backing layer could be separated from other elements of an article after embroidering one or more tape segments into place. In other embodiments, a backing layer could be dissolved. Such an embodiment is discussed below and depicted in FIG. 12.

Some embodiments may also include provisions for automatically feeding tape segments along one or more portions of an article. In the embodiment of FIG. 10, embroidery device 1010 includes continuous tape feeding assembly 1020 that is configured to continuously feed tape along predetermined locations of backing layer 1002 as embroidery device 1010 makes stitches into backing layer 1002. Where tape segments are placed onto backing layer 1002, embroidering device 1010 may control needle assembly 1012 to place predetermined stitches across the tape segments so as to lock them into place on backing layer 1002 and within the embroidered structure 1040 being formed throughout article 1000.

In some embodiments, only a single type of tape is stitched using a machine. In other embodiments, multiple types of tape may be stitched using the same tape-feeding assembly. In still other embodiments, an embroidery device may have multiple feeding assemblies to embroider multiple tape segments at the same time.

The method of stitching used to attach one or more tape segments may vary. In some embodiments, thread could be stitched around a tape segment, thereby securing the tape in place on a substrate layer. In other embodiments, thread could be stitched directly through a tape segment. In some cases, a tape segment could have preconfigured holes for receiving stitches. In other cases, a needle may pierce a tape segment to place a stitch through the tape segment.

The technique of stitching the tape segments to a substrate may vary. In some embodiments, the stitch technique used may include chain stitch, double chain stitch, the buttonhole or blanket stitch, the running stitch, the satin stitch, the cross stitch, or any other stitch technique known in the art. In other embodiments, a combination of known stitch techniques may be used. In further embodiments, these techniques may be used individually or in combination to stitch either individual tape segments or groups of tape segments in place.

The stitches may form a pattern. When the stitching is performed by a machine, the machine may use a computer-generated program to control the stitching, including the locations of the stitching relative to an underlying substrate, as well as how and which tape segments to feed, how to stitch the tape segments, and the technique of stitching used. In the illustrated embodiment of FIG. 10, individual tape segments are arranged in alternating diagonal paths that form overlapping V's along the article.

In other embodiments, the pattern of tape segments may comprise a curve, ovals, or other geometric shapes or combination of shapes, characters such as letters or numbers, symbols such as a trademark, as well as additional patterns disclosed herein.

Although the illustrated embodiment of FIG. 10 depicted tape segments embroidered directly to the upper of an article, similar methods may be used for embroidering tape segments to any substrate layer for use in any kinds of articles.

Figure 11:
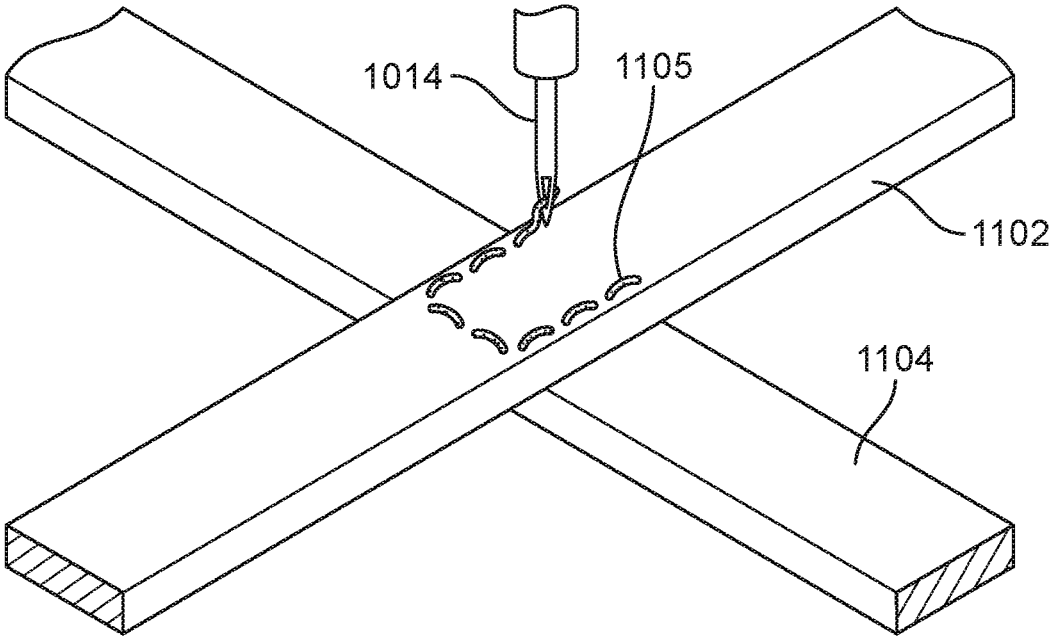
FIG. 11 is a schematic view of a step of embroidering two tape segments together, according to an embodiment.

In some cases, the exemplary method provides for stitching two tape segments together. As seen in FIG. 11, embroidery needle 1014 may be used to stitch thread 1105 through two intersecting tape segments (e.g., tape segment 1102 and tape segment 1104). In some embodiments, tape segments may only cross occasionally. However, in other embodiments, tape segments could intersect at many locations. In embodiments where there is a high density of crossings, the tape segments could form a lattice or other mesh-like pattern, including the pattern described above and shown in FIGS. 5-6. For purposes of illustration, the stitches in FIG. 11 are shown in the center of the tape segment. In other embodiments, however, stitches could be applied at any other locations including along one or both (lengthwise) edges of the tape segment. In different embodiments, different kinds of stitches could be used. As an example, FIG. 11 depicts two tape segments being joined using a box stitch.

As previously discussed, once an upper pattern has been stitched into place on backing layer 1002, some or all of backing layer 1002 could be removed.

Figure 12:
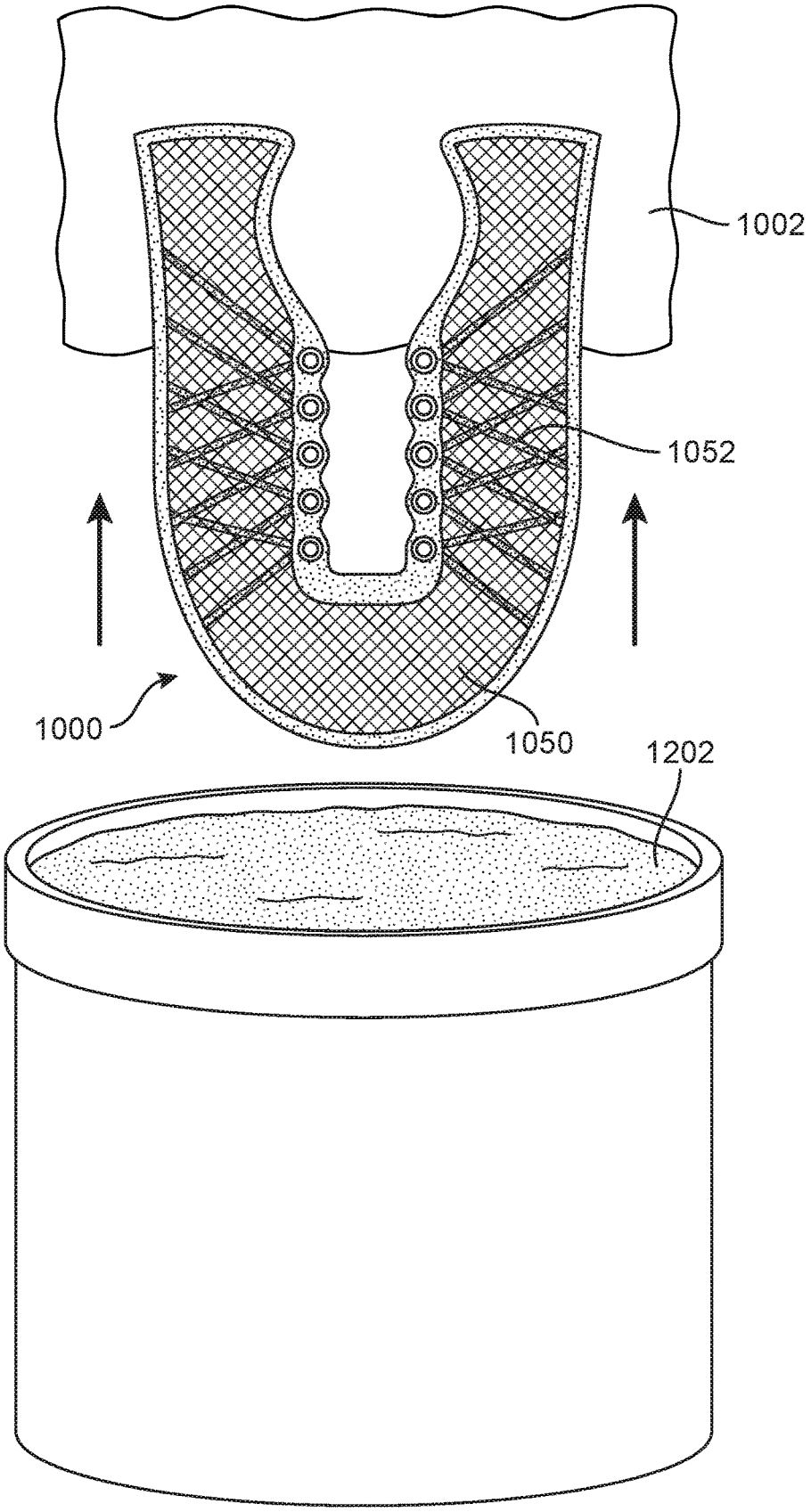
FIG. 12 is a schematic view of a step of removing a backing layer, according to an embodiment.

FIG. 12 is a schematic view of a step of dissolving backing layer 1002, once an upper pattern has been stitched to backing layer 1002. Here, the upper pattern is comprised of self-supporting embroidered structure 1050 incorporating multiple tape segments 1052. To dissolve backing layer 1002, dissolving mixture 1202 could be used. In some cases, as in FIG. 12, an embroidered assembly comprised of self-supporting embroidered structure 1050 and backing layer 1002 could be dipped into a container of dissolving mixture 1202.

Figure 13:
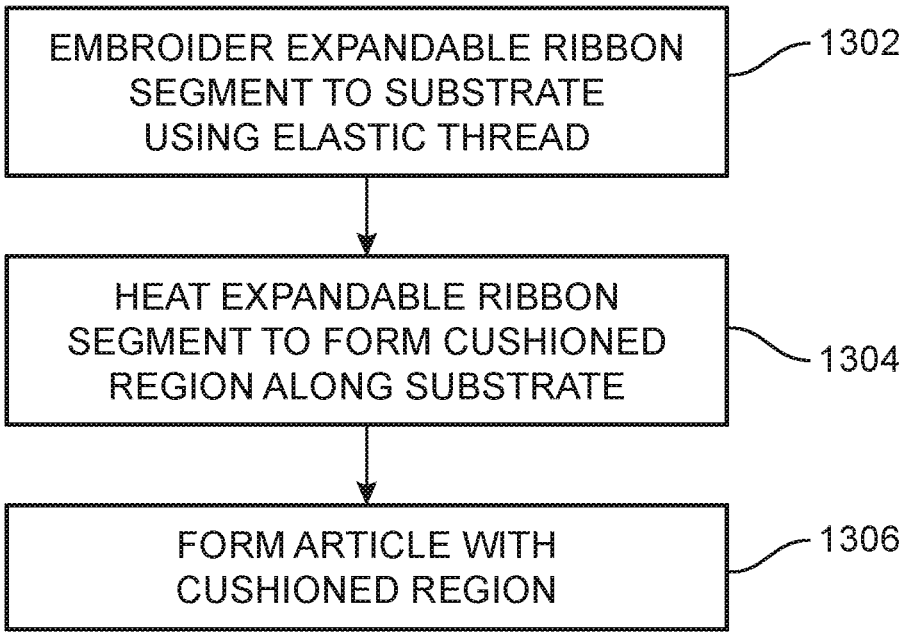
FIG. 13 is a schematic view of a chart for forming an article with a cushioning region, according to an embodiment.
Figure 14:
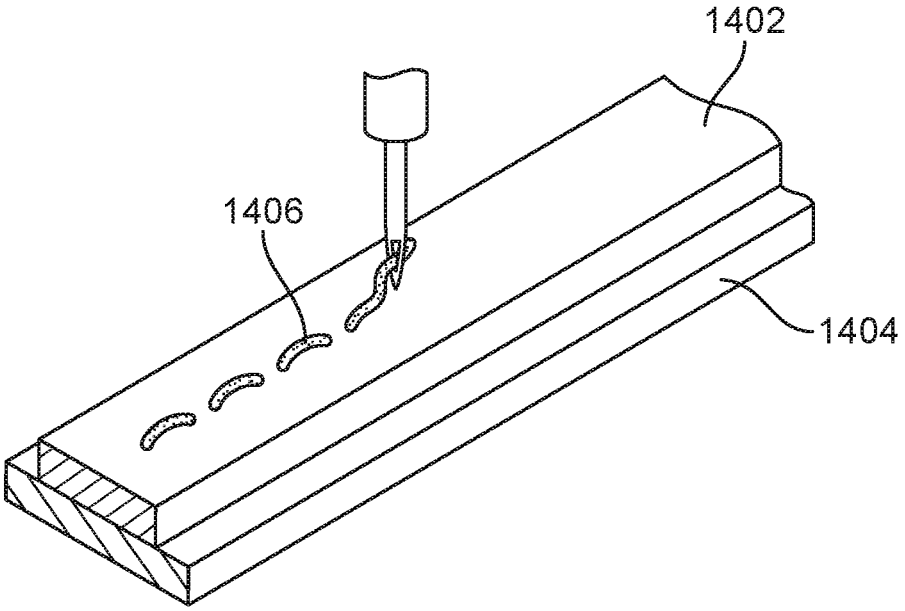
FIG. 14 is a schematic view of a step of embroidering an expandable tape segment to a substrate, according to an embodiment.
Figure 15:
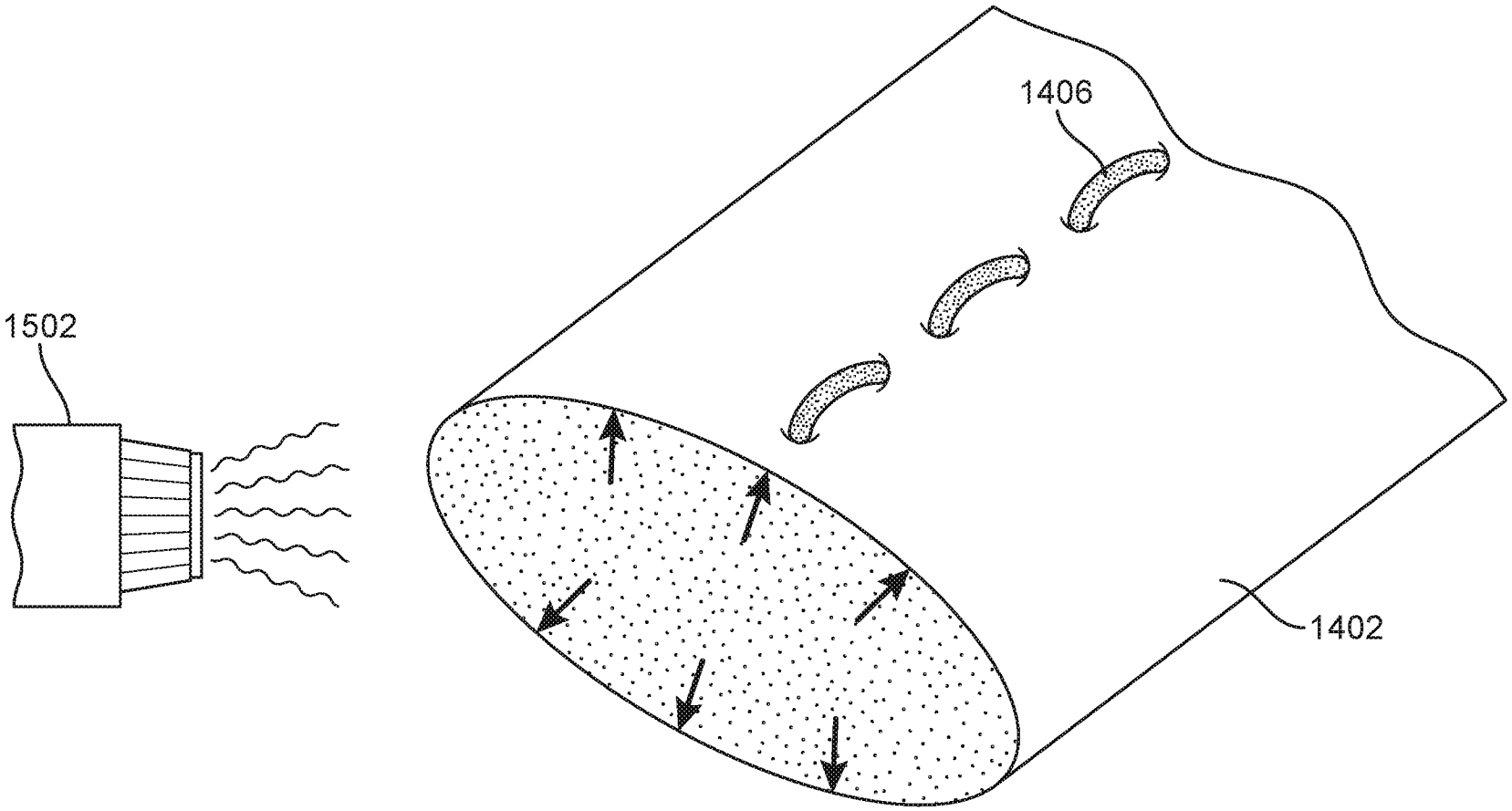
FIG. 15 is a schematic view of a tape segment expanding under heat, according to an embodiment.
Figure 16:
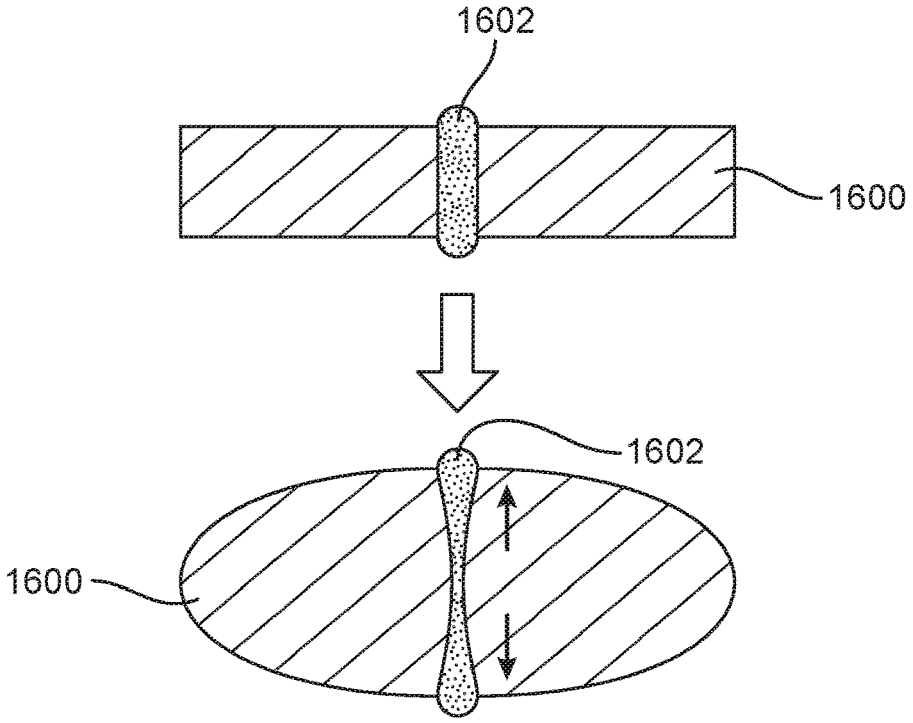
FIG. 16 is a schematic view of a tape segment expanding with an elastic thread stitched through the tape segment, according to an embodiment.

FIG. 13 is a schematic view of a process of creating a cushioned region for an article using expandable tape segments that are embroidered into place along the article. Several exemplary embodiments of these steps are depicted in FIGS. 14, 15, and 16. It may be appreciated that for purposes of clarity the embroidered stitches shown in these Figures may be schematic. In some cases, embroidered stitches formed by an embroidery machine may include both an outer thread and a bobbin thread that runs under the structure. Thus, where a single thread is depicted in the figures, some embodiments may include two threads that are crossed at some point as they extend through the thickness of a component (e.g., a piece of tape).

In step 1302, an expandable tape segment may be embroidered to a substrate layer. For example, FIG. 14 shows expandable tape 1402 that is stitched to substrate 1404 using thread 1406. In some cases, an elastic thread may be used. Using an elastic thread to stitch expandable tape segments in place may prevent pinching or unwanted deformations in the tape segments as discussed in further detail below.

Next, in step 1304, the expandable tape segment may be heated, thereby causing the expandable tape segment to expand. Upon expanding, the expandable tape segment may form a cushioned region along the substrate. In embodiments where multiple expandable tape segments may be positioned adjacent one another on a substrate, the multiple segments may collectively form a cushioned region of varying shapes and sizes. As an example, FIG. 15 illustrates a schematic view of expandable tape 1402 expanding when heat source 1502 is applied. It may be appreciated the degree of expansion could vary and may be controlled by varying materials, heating duration, and/or temperature of heating. Alternatively, it may be understood that in other embodiments an expandable tape segment could be made to expand using another mechanism such as pressure or light. Optional steps of curing the expandable tape segment could also be performed depending on the type of materials used.

It may be appreciated that in some embodiments, a substrate could be a removable backing layer that is removed following attachment of, and/or expansion of, the expandable tape segments.

Finally, in step 1306, the substrate with the newly formed cushioning region may be assembled into an article. For example, if the article is an article of footwear, the expanded tape segments may be placed at a tongue of the article, or at a collar of the article.

Figure 17:
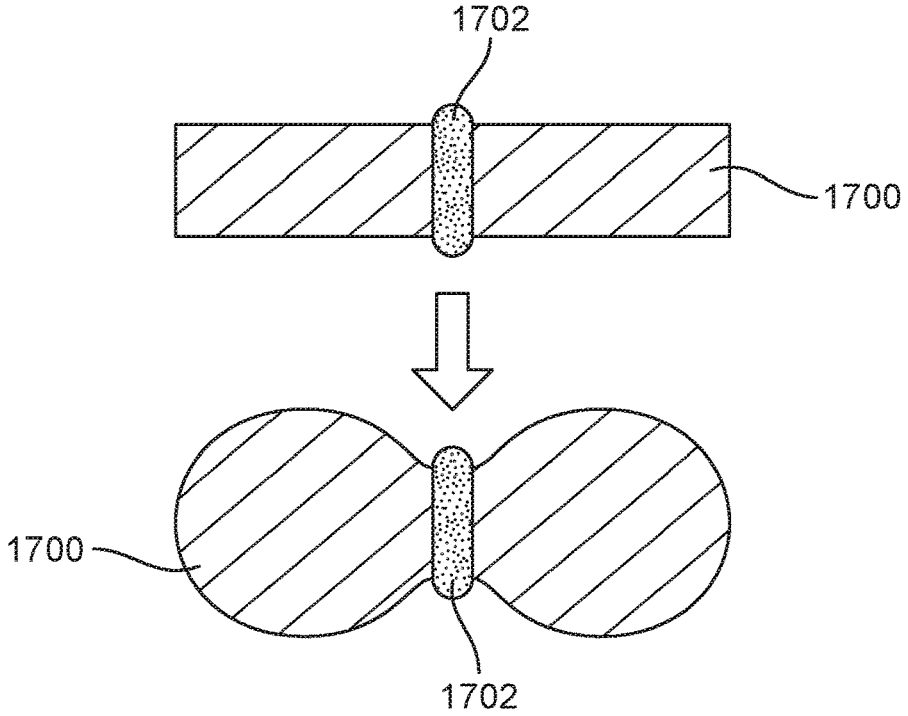
FIG. 17 is a schematic view of a tape segment expanding with an inelastic thread stitched through the tape segment, according to an embodiment.

FIG. 16 is a schematic view of expandable tape segment 1600 with stitch 1602 before and after expansion. In this case, stitch 1602 is comprised of an elastic thread. Therefore, as expandable tape segment 1600 expands, stitch 1602 stretches to accommodate the expansion. Such an arrangement may reduce the tendency of the expandable tape segment to pinch adjacent a stitch, as depicted in the alternative embodiment shown in FIG. 17. In this case, stitch 1702 is inelastic and fails to stretch as tape segment 1700 expands.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An upper for an article of footwear, comprising:

a substrate material layer; and a continuous embroidered lattice structure overlaid on the substrate material layer, the embroidered lattice structure comprising a plurality of tape segments attached to one another by stitches; and wherein the plurality of tape segments are disposed in a stacked arrangement, including a first plurality of tape segments in a first layer and a second plurality of segments in a second layer overlaid on the first layer.

2. The upper according to claim 1, wherein the continuous embroidered lattice structure is further comprised of a plurality of ribbon segments, the ribbon segments having a different material composition from the plurality of tape segments.

3. The upper according to claim 2, wherein the plurality of ribbon segments comprise a first set of ribbon segments oriented along a first direction and a second set of ribbon segments oriented along a second direction that is perpendicular to the first direction.

4. The upper according to claim 3, wherein the continuous embroidered lattice structure comprises a set of parallel tape segments extending in a third direction, wherein the third direction forms an oblique angle with the first direction.

5. The upper according to claim 4, wherein the first set of parallel ribbon segments are embroidered to the second set of parallel ribbon segments, and wherein the set of parallel tape segments are embroidered to the second set of parallel ribbon segments.

6. An upper for an article of footwear, comprising:

a forefoot region, a midfoot region, and a heel region formed of a continuous embroidered lattice structure, the embroidered lattice structure comprising a plurality of tape segments attached to one another by stitches;

wherein at least one expanded tape segment of the plurality of tape segments are formed of a material that is expandable by heat, and wherein the at least one expanded tape segment is in an expanded condition thus forming a cushioned region of the upper.

7. The upper according to claim 6, wherein the cushioned region is configured to form at least a portion of a tongue of an article of footwear.

8. The upper according to claim 6, wherein the cushioned region is configured to form at least a portion of a collar of an article of footwear.

9. The upper according to claim 6, wherein the at least one expanded tape segment is embroidered to a surface of a substrate layer.

10. The upper according to claim 9, wherein the substrate layer is a self-supporting embroidered layer.

11. The upper according to claim 6, wherein the at least one expanded tape segment is embroidered using an elastic thread capable of stretching as the at least one expanded tape segment expands.

12. An upper for an article of footwear, comprising:

a continuous embroidered structure including a first layer and a second layer overlaid on the first layer and selectively attached to the first layer with stitching;

wherein the second layer includes a plurality of tape segments; and wherein the first layer and the second layer are disposed in a stacked arrangement, wherein the plurality of tape segments are non-woven with the first layer of the continuous embroidered structure.

13. The upper of claim 12, wherein the first layer includes a plurality of additional tape segments.

14. The upper of claim 12, wherein the first layer includes a substrate material.

15. The upper of claim 14, wherein the substrate material includes a mesh material.

16. The upper of claim 12, further including a third layer, wherein the third layer includes a plurality of ribbon segments.

17. The upper of claim 16, wherein the first layer includes a plurality of additional tape segments.

18. The upper of claim 17, wherein the plurality of ribbon segments are oriented oblique to the plurality of tape segments in the second layer and/or oblique to the additional plurality of tape segments in the first layer.

19. The upper of claim 16, wherein the plurality of ribbon segments are formed of the same material as the plurality of tape segments.

20. The upper of claim 16, wherein the plurality of ribbon segments are formed of a different material than the plurality of tape segments.

* * * * *